US006732044B2

(12) United States Patent
Hashimoto et al.

(10) Patent No.: US 6,732,044 B2
(45) Date of Patent: May 4, 2004

(54) VEHICULAR ELECTRONIC CONTROL APPARATUS

(75) Inventors: Kohji Hashimoto, Tokyo (JP); Katsuya Nakamoto, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 84 days.

(21) Appl. No.: 10/212,045

(22) Filed: Aug. 6, 2002

(65) Prior Publication Data

US 2003/0158649 A1 Aug. 21, 2003

(30) Foreign Application Priority Data

Feb. 20, 2002 (JP) ..... P2002-043850

(51) Int. Cl.[7] ..... G06F 13/12; G06F 11/00

(52) U.S. Cl. ..... 701/114; 701/115; 701/102; 701/1

(58) Field of Search ..... 701/114, 115, 701/102, 1, 29, 43

(56) References Cited

U.S. PATENT DOCUMENTS 5,995,898 A * 11/1999 Tuttle ..... 701/102
6,112,152 A * 8/2000 Tuttle ..... 701/115
2003/0086226 A1 * 5/2003 Hashimoto et al. ..... 361/91.1
2003/0221668 A1 * 12/2003 Hashimoto et al. ..... 123/396

FOREIGN PATENT DOCUMENTS

| | | | |
|---|---|---|---|
| EP | o 666 199 A1 * | 8/1995 | ..... G06F/13/42 |
| JP | 5-81222 | 4/1993 | |
| JP | 5-119811 | 5/1993 | |
| JP | 7-13912 | 1/1995 | |
| JP | 7-196003 | 8/1995 | |
| JP | 8-305681 | 11/1996 | |
| JP | 8-339308 | 12/1996 | |
| JP | 9-83301 | 3/1997 | |
| JP | 2000-68833 | 3/2000 | |
| JP | 2000-89974 | 3/2000 | |

* cited by examiner

*Primary Examiner*—Hieu T. Vo
(74) *Attorney, Agent, or Firm*—Sugrue Mion, PLLC

(57) ABSTRACT

A core integrated circuit device has a microprocessor. A first ancillary integrated circuit device has an indirect parallel input circuit that receives low-speed digital signals parallel, and the first ancillary integrated circuit device outputs the received digital signals serially to the core integrated circuit device. A second ancillary integrated circuit device has a multi-channel A/D converter that receives analog signals parallel and converts those into digital signals, and the second ancillary integrated circuit device outputs the digital signals serially to the core integrated circuit device. The core integrated circuit device generates control signals based on the received signals and outputs the control signals to control object devices.

19 Claims, 14 Drawing Sheets

VEHICULAR ELECTRONIC CONTROL APPARATUS

BACKGROUND OF THE INVENTION

1. Field of the Invention

The present invention relates to a vehicular electronic control apparatus that incorporates a microprocessor and is used for fuel supply control of a vehicle engine. In particular, the invention relates to a vehicular electronic control apparatus that is miniaturized and standardized by improving how to handle a lot of input and output signals as well as improved in safety.

2. Description of the Related Art

FIG. 14 is a block circuit diagram of a conventional vehicular electronic control apparatus.

In FIG. 14, reference numeral 1 denotes an ECU (engine control unit) formed on a single printed circuit board and reference numeral 2 denotes a large-sized LSI (integrated circuit part) of the ECU 1. The LSI 2 is configured in such a manner that a CPU (microprocessor) 3, a nonvolatile flash memory 4, a RAM 5, an input data selector 6, an A/D converter 7, an output latch memory 8, etc. are connected to each other. Reference numeral 9 denotes a power supply unit for supplying control power to the ECU 1; 10, a vehicle battery; 11, a power line that connects the vehicle battery 10 and the ECU 1; and 12, a power switch.

The ECU 1 operates being supplied with control power from the power supply unit 9 that is supplied with power by the vehicle battery 10 via the power line 11 and the power switch 12. Programs to be executed by the ECU 1, control constants for engine control, etc. are stored in the nonvolatile flash memory 4 in advance.

Reference numeral 13 denotes various sensor switches; 14, bleeder resistors; 15, series resistors; 16, parallel capacitors; 17, input resistors; 18, positive feedback resistors; and 19, comparators. Each of a lot of ON/OFF input signals coming from the various sensor switches 13 is supplied to the associated comparator 19 via the bleeder resistor 14 as a pull-up or pull-down resistor and the series resistor 15 and the parallel capacitor 16 which constitute a noise filter. The input resistor 17 and the positive feedback resistor 18 are connected to each comparator 19. If the voltage across a certain parallel capacitor 16 exceeds a reference voltage that is applied to the negative-side terminal of the associated comparator 19, the comparator 19 supplies a signal having a logical value "H" to the data selector 6.

When the voltage across a certain parallel capacitor 16 decreases, addition of a voltage that is fed back by the positive feedback resistor 18 occurs and hence the output voltage of the comparator 19 does not return to a logical value "L" until the voltage across the parallel capacitor 16 becomes lower than the reference voltage.

As described above, each comparator 19 has the function of a level judgment comparator including a hysteresis function. Outputs of the many comparators 19 are stored in the RAM 5 via the data selector 6 and a data bus 30.

The data selector 6, which handles inputs of 16 bits, for example, outputs signals to the data bus 30 when receiving a chip-select signal from the CPU 3. Actually a plurality of data selectors 6 are used because there exist tens of input points.

Reference numeral 20 denotes various analog sensors; 21, series resistors; and 22, parallel capacitors.

Each of a lot of analog signals coming from the various analog sensors 20 is supplied to the associated A/D converter 7 via the series resistor 21 and the parallel capacitor which constitute a noise filter. A digital output of an A/D converter 7 that has received a chip-select signal from the CPU 3 is stored in the RAM 5 via the data bus 30.

A control output of the CPU 3 is stored in the latch memory 8 via the data bus 30, and is used for driving an external load via the associated output transistor 23. Actually a plurality of latch memories 8 to accommodate a lot of control outputs. Control outputs are stored in a latch memory 8 that has been chip-selected by the CPU 3.

Reference numeral 24 denotes drive base resistors for the respective transistors 23; 25, stabilization resistors each of which is connected between the base and the emitter of the associated transistor 23; 26, external loads; and 27, a power relay for supplying power to the external loads 26.

The conventional apparatus having the above configuration has the following problems. The LSI 2 has a large scale because the CPU 3 handles a very large number of inputs and outputs. The parallel capacitors 16 and 22 which constitute noise filters need to have various capacitance values to obtain desired filter constants, and hence it is difficult to standardize the parallel capacitors 16 and 22. A large capacitor is needed to obtain a large filter constant, which is a factor of increasing the size of the ECU 1.

Among measures for decreasing the size of the LSI 2 by decreasing the number of input and output terminals is a method of exchanging a lot of input and output signals in a time-divisional manner using a serial communication block as disclosed in Japanese Patent Laid-Open No. 13912/1995 (title: Input/output processing IC).

However, this method requires noise filters having various capacitance values and hence is not suitable for standardization of an apparatus. Further, this method is not suitable for miniaturization of an apparatus either because large capacitance values are needed to obtain sufficiently large filter constants.

On the other hand, a concept is known that a digital filter is used as a noise filter for an on/off input signal and its filter constant is controlled by a microprocessor.

For example, Japanese Patent Laid-Open No. 119811/1993 (title: Programmable controller) discloses a method in which if sampled input logical values of an external input signal have the same value plural times that value is employed and stored in an input image memory, and in which a filter constant changing instruction capable of changing the sampling period is provided.

Although this method has an advantage that the filter constant can be changed freely, the microcomputer is caused to bear a heavy load when a lot of input signals need to be processed. As a result, the response speeds of control operations of the microprocessor lower though the control operations are primary operations of the microprocessor.

Japanese Patent Laid-Open No. 2000-89974 (title: Data storage control device) also discloses a digital filter for an on/off signal. A shift register is provided as hardware and sampling processing is performed according to the same concept as described above.

Japanese Patent Laid-Open No. 83301/1997 (title: Switched capacitor filter) discloses a digital filter using a switched capacitor which serves as a noise filter for multichannel analog input signals.

Also in this case, the microcomputer is caused to bear a heavy load when a lot of analog input signals need to be processed. As a result, the response speeds of control operations of the microprocessor becomes even lower though the control operations are primary operations of the microprocessor.

Japanese Patent Laid-Open No. 305681/1996 (title: Microcomputer) discloses a filter in which the filter constant is changed by switching, in multiple steps, the resistor of an analog filter that consists of a resistor and a capacitor. Japanese Patent Laid-Open No. 2000-68833 (title: Digital filter system) discloses a moving average type digital filter in which the arithmetic mean value of a plurality of time-series sampling data is employed as data of current time after analog values are converted into digital values.

Various known techniques relating to watching for a runaway and reactivation control of a microprocessor that should be pointed out in connection with the invention are as follows.

Japanese Patent Laid-Open No. 196003/1995 (title: Control system of vehicular safety device) discloses the following. An AND circuit is provided in a driving circuit of a vehicular safety device that is drive-controlled by a microcomputer. The vehicular safety device such as an airbag is driven based on the AND of an output of a judgment circuit that an activation permission signal when a watchdog pulse of the microcomputer is normal and an activation instruction signal of the microcomputer. This technique has a problem that when the microcomputer has been reactivated by a reset pulse, the vehicle driver cannot recognize a temporary runaway of the microcomputer.

Japanese Patent Laid-Open No. 81222/1993 (title: Operation monitoring method of two CPUs) discloses the following. In a system including two CPUs, that is, a main CPU and a sub-CPU, when the main CPU has run away or gone out of order, both CPUs are initialized and reactivated by a rest signal that is output from an externally provided watchdog timer circuit. When the sub-CPU has run away or gone out of order, the main CPU detects it and outputs a reset signal to the sub-CPU to initialize and reactivate the sub-CPU. This technique also has a problem that when the microcomputer has been reactivated by a reset pulse, the vehicle driver cannot recognize a temporary runaway of the microcomputer.

On the other hand, Japanese Patent Laid-Open No. 339308/1996 (title: Digital processing device) discloses the following. A microcomputer is completely stopped when a watchdog timer has detected an abnormality of the microcomputer. A system is so configured that to recover the microcomputer it is necessary to stop the supply of operation power to the microcomputer and then restart supply of operation power.

This technique has an advantage that the vehicle driver can recognize an abnormality of the microcomputer because the microcomputer cannot be reactivated unless the power switch is opened and then closed.

As understood from the above description, the above conventional techniques are partial miniaturization and standardization techniques and no full-scale miniaturization and standardization has not been attained by unifying those techniques.

In particular, there remains a problem that the control capabilities and the response speeds of a microcomputer as its primary capabilities necessarily lower in an attempt to miniaturize and standardize an input/output circuit section of the microprocessor.

In addition, where an ancillary integrated circuit device is added to a core integrated circuit device including a microcomputer, a sufficient safety measure should be taken against erroneous operation etc. of the microprocessor due to occurrence of noise.

SUMMARY OF THE INVENTION

A first object of the present invention is to provide a vehicular electronic control apparatus in which an external integrated circuit device is used to standardize a microprocessor in the case where the number of input and output points varies, and which can increase the response speed of input/output processing and improve the safety from a noise-induced erroneous operation of the microprocessor.

A second object of the invention is to provide a vehicular electronic control apparatus which can not only accommodate a variation in the number of input and output points but also attain its miniaturization and standardization by improving input filter sections.

The invention provides a vehicular electronic control apparatus including a core integrated circuit device, a first ancillary integrated circuit device, and a second ancillary integrated circuit device.

The core integrated circuit device includes a microprocessor, the first ancillary integrated circuit device for receiving low-speed digital signals is connected to the core integrated circuit device in such manner that serial communication is performed with each other and the second ancillary integrated circuit device for receiving analog signals is connected to the core integrated circuit device in such manner that serial communication is performed with each other.

The core integrated circuit device further includes:

a direct parallel input circuit and a direct parallel output circuit for inputting and outputting signals from and to control object devices, a first parent station serial/parallel converter and a second parent station serial/parallel converter, a first nonvolatile memory to which control programs that serve to control the control object devices are written from an external tool, and a first RAM for computation, and the microprocessor of the core integrated circuit device to which the direct parallel input circuit, the direct parallel output circuit, the first and second parent station serial/parallel converters, the first nonvolatile memory, and the first RAM are bus-connected.

The first ancillary integrated circuit device includes:

a first child station serial/parallel converter connected to the first parent serial/parallel converter of the core integrated circuit device in such a manner that serial communication is performed with each other, and an indirect parallel input circuit for receiving the low-speed digital signals in parallel, and the first ancillary integrated circuit device outputs the digital signals received by the indirect parallel input circuit to the core integrated circuit device through the first child station serial/parallel converter.

The second ancillary integrated circuit device includes:

a second child station serial/parallel converter connected to the core integrated circuit device in such a manner that serial communication is performed with each other, and a multi-channel analog-to-digital converter for receiving the analog signals parallel and for converting the received analog signals into digital signals, and the second ancillary integrated circuit device outputs the digital signals converted by the multi-channel analog-to-digital converter to the core integrated circuit device through the second child station serial/parallel converter.

And the core integrated circuit device generates control signals based on the input signals received from the control object devices, the digital signals received from the first ancillary integrated circuit device, and the digital signals received from the second ancillary integrated circuit device, and outputs the generated control signals to the control object devices.

According to the vehicular electronic control apparatus of the invention, not only can the core integrated circuit device be standardized even in the case where the number of control input and output points varies with control object devices, but also the speed of exchange of input and output information can be increased by decreasing the degree of congestion of communication lines by means of the double serial communication lines that are separated into the analog system and the digital system. This makes it possible to attain high operation speeds, high performance, and an increased degree of multi-functionality.

DESCRIPTION OF THE PREFERRED EMBODIMENTS

First Embodiment (1) Detailed Description of Configuration of First Embodiment A vehicular electronic control apparatus according to a first embodiment of the invention will be hereinafter described with reference to the drawings.

Figure 1:
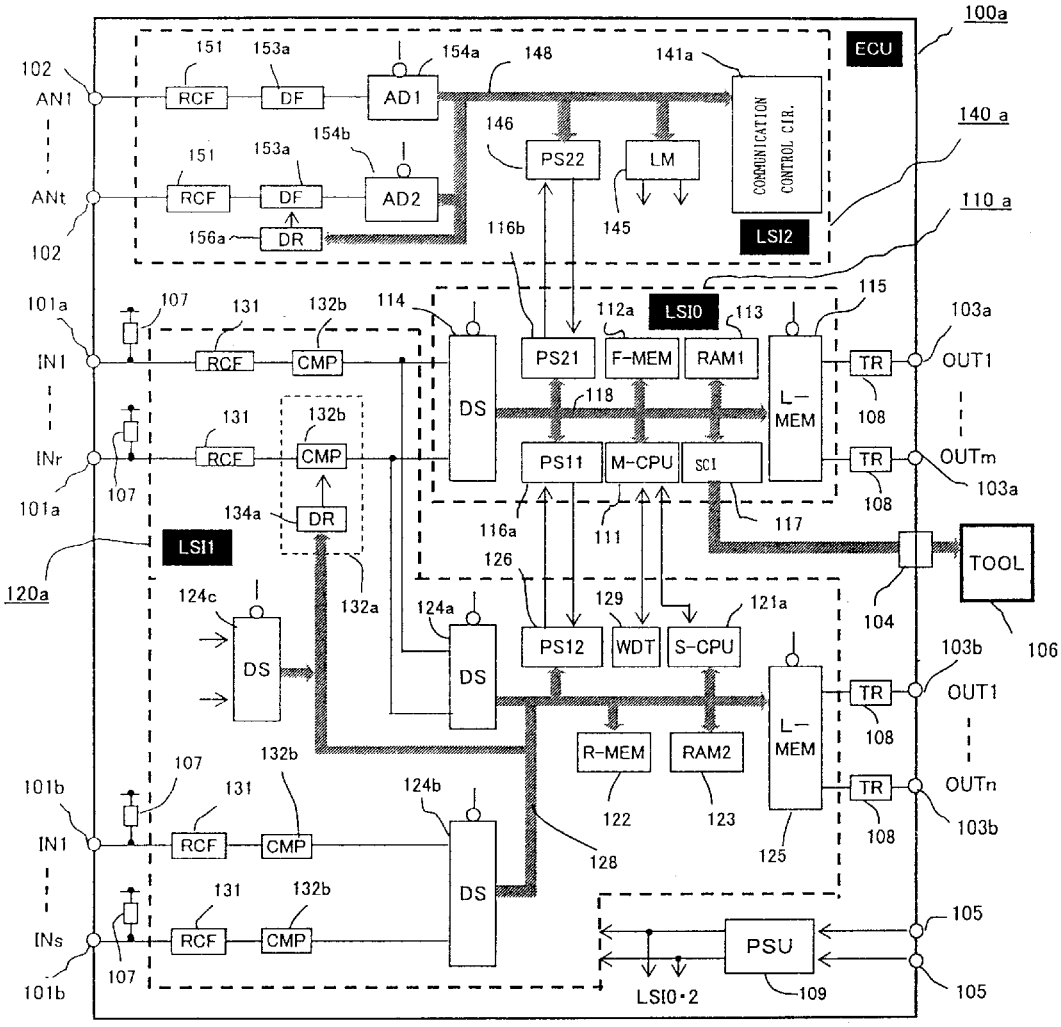
FIG. 1 is a block circuit diagram of a vehicular electronic control apparatus according to a first embodiment of the present invention.

FIG. 1 is a block circuit diagram of the vehicular electronic control apparatus according to the first embodiment of the invention. As shown in FIG. 1, reference symbol 100*a* denotes an ECU (vehicular electronic control apparatus) for controlling devices to be controlled. The ECU 100*a* is a single electronic circuit board having, as major parts, a core integrated circuit device 110*a*, a first ancillary integrated circuit device 120*a*, and a second ancillary integrated circuit device 140*a*.

Reference symbol 101*a* denotes connector terminals to receive high-speed input signals IN1–INr of on/off operations that are operations of relatively high frequencies performed by such devices as a crank angle sensor for control of engine igniting timing and fuel injection timing and a vehicle speed sensor for auto-cruise control, and that require quick capture of signals.

Reference symbol 101*b* denotes connector terminals to receive low-speed input signals IN1–INs of on/off operations that are operations of relatively low frequencies performed by such devices as a selector switch for detecting a gearshift position and an air-conditioner switch, and with which delay in signal capturing causes no serious problems.

Reference symbol 102 denotes connector terminals to receive analog input signals AN1–ANt that are output from an intake amount sensor, a cylinder pressure sensor, a throttle position sensor for detecting the degree of opening of intake valves, an accelerator position sensor for detecting the degree of a press on an accelerator, a water temperature sensor, an exhaust gas oxygen concentration sensor, etc.

Reference symbol 103*a* denotes connector terminals to output high-speed output signals OUT1–OUTm of on/off operations that are operations of relatively high frequencies such as driving of engine ignition coils (in the case of a gasoline engine) and driving of solenoid-controlled valves for fuel injection control, and that require generation of drive output signals without delay.

Reference symbol 103*b* denotes connector terminals to output low-speed output signals OUT1–OUTn of on/off operations that are operations of relatively low frequencies such as driving of a solenoid-controlled valve for a transmission and driving of an electromagnetic clutch for the air-conditioner, and with which response delay of drive output signals causes no serious problems.

Reference numeral 104 denotes a detachment connector to which an external tool 106 for transferring and writing control programs, control constants, etc. to the ECU 100*a* in advance is to be connected. The external tool 106 is used at the time of product shipment or maintenance work in such a manner as to be connected to the ECU 100*a* via the detachment connector 104.

Reference numeral 105 denotes power terminals that are connected to a vehicle battery. The power terminals 105 are a terminal that is supplied with power via a power switch (not shown) and a sleep terminal that is supplied with power directly by the vehicle battery to maintain operation of a memory (described later).

Reference numeral 107 denotes bleeder resistors having a small resistance of several kilo-ohms that are connected to the respective input connectors 101*a* and 101*b* for on/off signals. Each bleeder resistor 107 stabilizes the input signal level while an input switch (not shown) is off by pulling up or down the associated input terminal so as to serve as a load of the input switch, as well as prevents a contact failure by increasing an amount of current while the input switch is on. The bleeder resistors 107 are connected to an external printed circuit board of the first ancillary integrated circuit device 120*a*.

Reference numeral 108 denotes output interface circuits such as transistors that are provided in output sections of the core integrated circuit device 110*a* and the first ancillary integrated circuit device 120*a*. Reference numeral 109 denotes a power supply unit that is supplied with power via the power terminals 105, and generates regulated voltages for control and supplies those to the respective integrated circuit devices.

The core integrated circuit device 110*a* is composed of a main CPU (microprocessor) 111, a first nonvolatile memory 112*a*, a first RAM 113 for computation, an input data selector 114 that is a direct parallel input circuit, an output latch memory 115 that is a direct parallel output circuit, first and second parent station serial/parallel converters 116*a* and 116*b* that exchange serial signals with the first and second ancillary integrated circuit devices 120*a* and 140*a* (described later), an SCI (serial communication interface) 117 that exchange serial signals with the external tool 106, and other components. The above components are connected to the main CPU 111 via a data bus 118 of 8–32 bits.

For example, the first nonvolatile memory 112*a* is a flash memory to which data can be written en bloc. Transfer control programs, vehicle control programs, vehicle control constants, etc. are transferred and written to the first nonvolatile memory 112*a* from the external tool 106 via the first RAM 113.

The first ancillary integrated circuit 120*a* is composed of a sub-CPU (sub-microprocessor) 121*a*, a second nonvolatile memory 122, a second RAM 123 for computation, an input data selector 124*a* that is a parallel input circuit for monitoring, an input data selector 124*b* that is an indirect parallel input circuit, an input data selector 124*c* that is a digital conversion input circuit for monitoring, an output latch memory 125 that is an indirect parallel output circuit, and a first child station serial/parallel converter 126 that is serially connected to the first parent station serial/parallel converter 116*a*. The above components are connected to the sub-CPU 121*a* via an 8-bit data bus 128.

The second nonvolatile memory 122 is a mask ROM (read-only memory), for example. Programs of input/output control to be performed by the sub-CPU 121*a*, programs for communication with the main CPU 111, etc. are stored in the second nonvolatile memory 122.

Reference numeral 129 denotes a watchdog timer that is directly connected to a watchdog signal output terminal and a reset signal input terminal of the main CPU 111. When the pulse width of a watchdog signal has exceeded a prescribed value, the watchdog timer 129 generates a reset pulse signal and reactivates the main CPU 111.

A noise filter 131 and a variable threshold circuit 132*a* (described later in detail with reference to FIG. 2(*a*)) that is composed of a level judgment comparator 132*b* and a constant setting register 134*a* are connected to each input terminal of the input data selector 114. A noise filter 131 and a level judgment comparator 132*b* (described later) are connected to each input terminal of the input data selector 124*b*.

The second ancillary integrated circuit device 140*a* is composed of a communication control circuit 141*a* (described later in detail with reference to FIG. 3), multi-channel A/D converters 154*a* and 154*b* of 10 bits and 16 channels, for example, an output latch memory 145 that is a digital conversion output circuit in which part of A/D-converted output signals of the A/D converters 154*a* and 154*b* are stored, and a second child station serial/parallel converter 146 that is serially connected to the second parent station serial/parallel converter 116*b*. The above components are connected to each other via a data bus 148.

Variable filter circuits 153*a* (described later in detail with reference to FIG. 3) each having a noise filter 151 and a constant setting register 156*a* are connected to analog input circuits of the multi-channel A/D converters 154*a* and 154*b*.

As described later in detail, one of a pair of accelerator position sensors APS1 and APS2 and one of a pair of throttle position sensors TPS1 and TPS2 are connected to the multi-channel A/D converter 154*a*. The other of the pair of accelerator position sensors APS1 and APS2 and the other of the pair of throttle position sensors TPS1 and TPS2 are connected to the multi-channel A/D converter 154*b*. In this manner, a double-system circuit is formed for each of the acceleration position sensor and the throttle position sensor.

A/D-converted output signals of one of the accelerator position sensors APS1 and APS2 and one of the throttle position sensors TPS1 and TPS2 are stored in the output latch memory 145. The outputs of the output latch memory 145 are connected to the respective input terminals of the input data selector 124*c* as a digital conversion input circuit for monitoring that is provided in the first ancillary integrated circuit device 120*a*.

Figure 2:
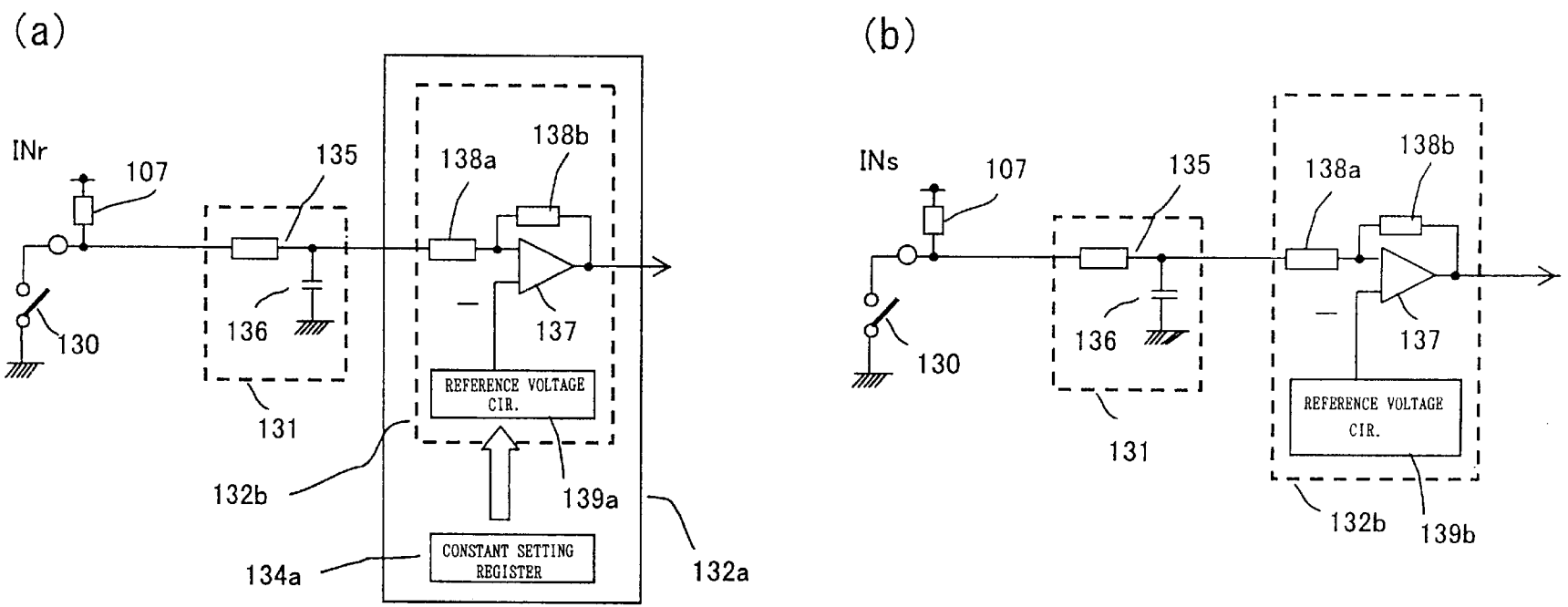
FIGS. 2A and 2B show on/off input circuits of the vehicular electronic control apparatus of FIG. 1.

FIGS. 2(*a*) and 2(*b*) show on/off input circuits of the vehicular electronic control apparatus of FIG. 1. FIG. 2(*a*) shows a case of using a variable threshold circuit and FIG. 2(*b*) shows a case of using a level judgment comparator.

In FIGS. 2(*a*) and 2(*b*), the components 107, 131, 132*a*, and 132*b* are the same as shown in FIG. 1. Reference symbol 130 denotes an input switch; 134*a*, a constant setting register; 135, a series resistor; 136, a small-capacitance capacitor; 137, a comparator; 138*a*, an input resistor; 138*b*, a positive feedback resistor; and 139*a* and 139*b*, reference voltage circuits.

As shown in FIG. 2A, the input terminal INr to which the input switch 130 is connected is provided with the small-resistance bleeder resistor 107 and is connected to the small-capacitance (tens of picofarads) capacitor 136 via a large-resistance (hundreds of kilo-ohms that is a practicable upper limit value) series resistor 135. The noise filter 131, which is composed of the series resistor 135 and the small-capacitance capacitor 136, smoothes out a signal by absorbing noise.

As for the level judgment comparator 132*b* including the input resistor 138*a*, the positive feedback resistor 138*b*, and the comparator 137, a prescribed reference voltage Von is applied to the negative-side input terminal of the comparator 137 by the reference voltage circuit 139*a*.

Therefore, if the voltage across the small-capacitance capacitor 136 becomes higher than the reference voltage Von, a voltage "H" (logical value "1") appears at the output of the comparator 137. However, once the output voltage of the comparator 137 has become "H," addition of a voltage that is fed back by the positive feedback resistor 138*b* occurs at the positive-side input terminal of the comparator 137 and hence the output voltage of the comparator 137 does not become "L" (logical value "0") unless the voltage across the small-capacitance capacitor 136 becomes lower than Voff (<Von). A hysteresis function is thus realized.

This is to prevent the output voltage of the comparator 137 from being inverted at a high frequency due to a noise ripple that is superimposed on the voltage across the small-capacitance capacitor 136.

A voltage division ratio constant indicating a voltage to be generated by the reference voltage circuit 139*a* is stored in the constant setting register 134*a*. The reference voltage that is a divided voltage corresponding to the constant stored in the constant setting register 134*a* is applied to the inverting input of the comparator 137.

The variable threshold circuit 132*a* is composed of the level judgment comparator 132*b* and the constant setting register 134*a*.

The circuit of FIG. 2(*b*) is the same as the circuit of FIG. 2(*b*) except that in the former the constant setting register 134*a* is not provided and the reference voltage circuit 139*b* generates a fixed reference voltage.

Figure 3:
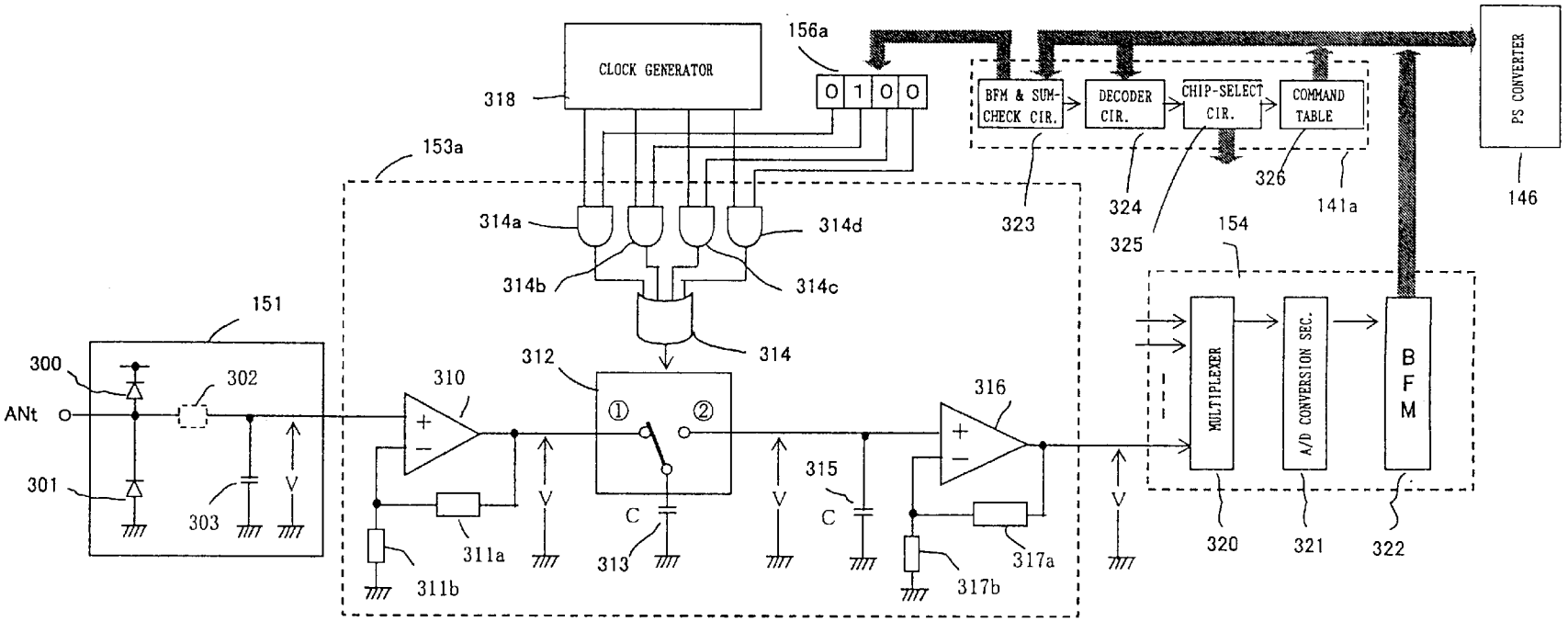
FIG. 3 shows an analog variable filter circuit of the vehicular electronic control apparatus of FIG. 1.

FIG. 3 shows an analog variable filter circuit of the vehicular electronic control apparatus of FIG. 1.

In FIG. 3, the components 141*a*, 146, 151, 153*a*, and 156*a* are the same as shown in FIG. 1. Reference numeral 154 represents 154*a* and 154*b*.

Reference numeral 151 denotes a noise filter for an analog input signal ANt. The noise filter 151 is composed of a positive-side clip diode 300, a negative-side clip diode 301, a series resistor 302, and a small-capacitance capacitor 303.

The clip diodes 300 and 301 prevent a voltage that is higher than an assumed maximum value of the analog input signal ANt or lower than its assumed minimum value from being applied to the small-capacitance capacitor 303 when large noise is superimposed on the analog input signal ANt, by returning the noise to the positive or negative side of the power supply.

Where an analog sensor has a proper internal resistance, the series resistor 302 may be omitted.

Reference numeral 310 denotes an amplifier; 312, a switch; 313, a switched capacitor; 315, a capacitor; 316, an amplifier; 320, a multiplexer; and 321, an A/D conversion section.

A capacitor C0 of the switched capacitor 313 is connected to a signal side ① or an output side ② periodically by the switch 312 in which a switching period T is set by a constant setting register 156*a* that is a period setting means.

A voltage V1 across the small-capacitance capacitor 303 is applied to the signal side ① via the amplifier 310. The capacitor 315 is connected to the output side ②. A voltage V2 across the capacitor 315 is supplied to the A/D conversion section 321 of the multi-channel A/D converter 154 via the amplifier 316 and the multiplexer 320 that is an input selection circuit.

Reference symbols 311*a* and 311*b* denote negative feedback voltage division resistors for the amplifier 310; 317*a* and 317*b*, negative feedback voltage division resistors for the amplifier 316; and 322, a buffer memory of 10 bits and 16 points, for example, that store digital conversion values, obtained by A/D conversion by the A/D conversion section 321, of respective analog signals.

Reference symbol 318 denotes a clock generator that generates clock pulse signals of four frequencies, for example; 314*a*–314*d*, AND elements as gate circuits that are connected to the respective clock output terminals of the clock generator 31; and 314, an OR element that is connected to the outputs of the AND elements 314*a*–314*d*, respectively. Bit memories of the constant setting register 156*a* are connected to the respective AND elements 314*a*–314*d*. A clock pulse signal that is output from one of the AND elements 314*a*–314*d* that is selected by the constant setting register 156*a* is applied to a switching period setting circuit of the switch 312 via the OR element 314.

In the above-configured switched capacitor 313, the following equations hold if the charging/discharging resistance for the capacitor C0 is sufficiently small:

Charge accumulated in capacitor C0 when switching is made to side ①:

$$Q1=C0\times V1$$

Charge accumulated in capacitor C0 when switching is made to side ②:

$$Q2=C0\times V2$$

Charge transferred in T seconds:

$$Q=Q1-Q2=C0(V1-V2)$$

Average current in T seconds:

$$I=Q/T=C0(V1-V2)/T$$

Equivalent resistance:

$$R0=(V1-V2)/I=T/C0$$

Therefore, the switched capacitor 313 is equivalent to a filter that is composed of a series resistor having the resistance R0 and the capacitor 315. The resistance R0 increases in proportion to the switching period T, which is stored in the constant setting register 156*a*.

Reference numeral 323 denotes a buffer memory that stores command information and a variable filter constant that are supplied from the main CPU 111 via the second child station serial/parallel converter 146 and a sum-check circuit that checks the contents of the buffer memory. Reference numeral 324 denotes a decoder circuit that recognizes the contents of the command information that is input to the decoder circuit 324 if a sum-check result is normal. Reference numeral 325 denotes a chip-select circuit that is responsive to an output of the decoder circuit 324 and selects a memory as a storage destination of received data or a storage source of data to be sent. Reference numeral 326 denotes a command table that is to be selected by the chip-select circuit 325 and contains reply commands such as ACK and NACK. The circuits from the sum-check circuit 323 to the command table 326 constitute the communication control circuit 141*a*.

(2) Detailed Description of Operation of First Embodiment

Figure 4:
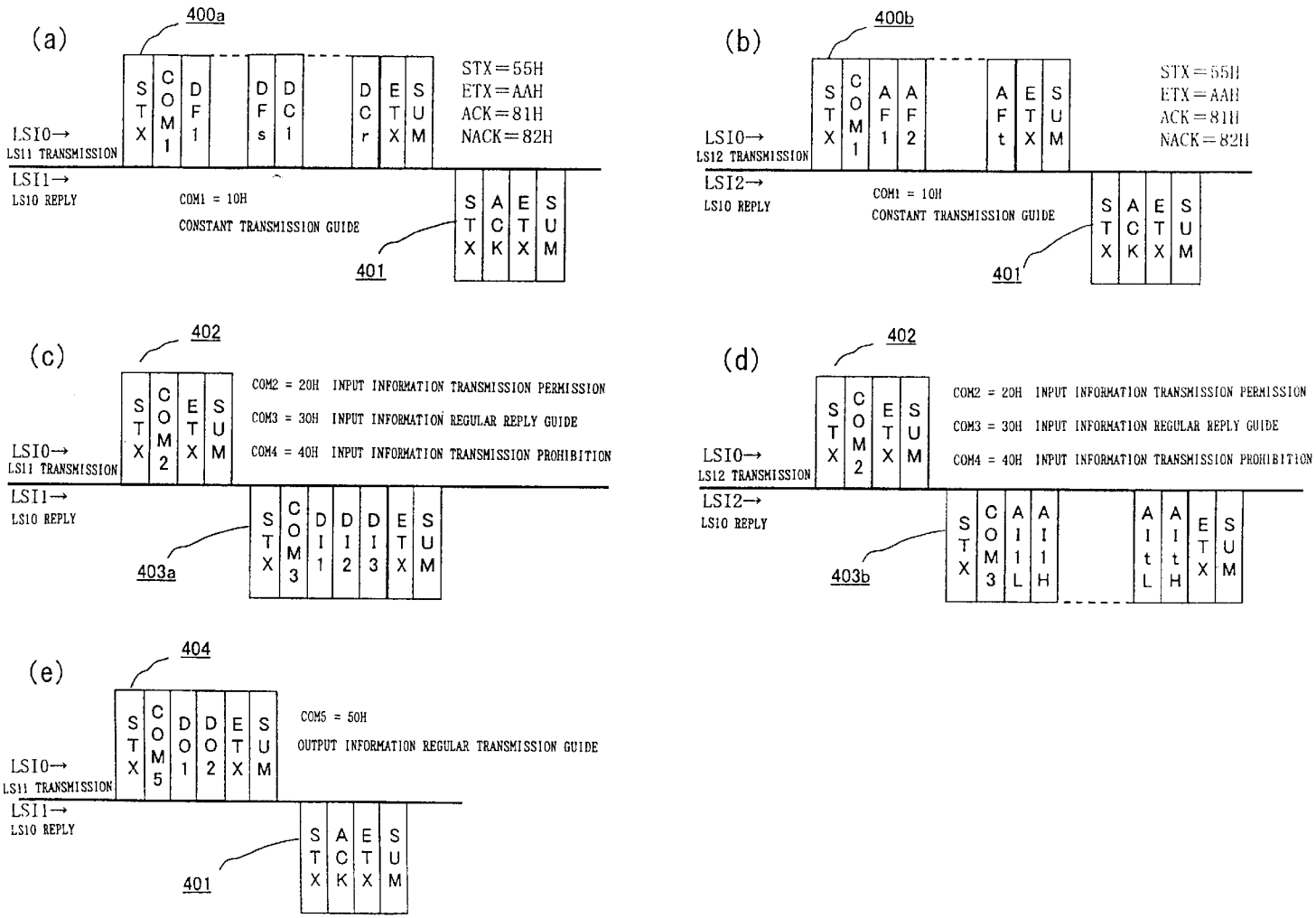
FIGS. 4A–4E show five communication frame structures of the vehicular electronic control apparatus of FIG. 1.
Figure 5:
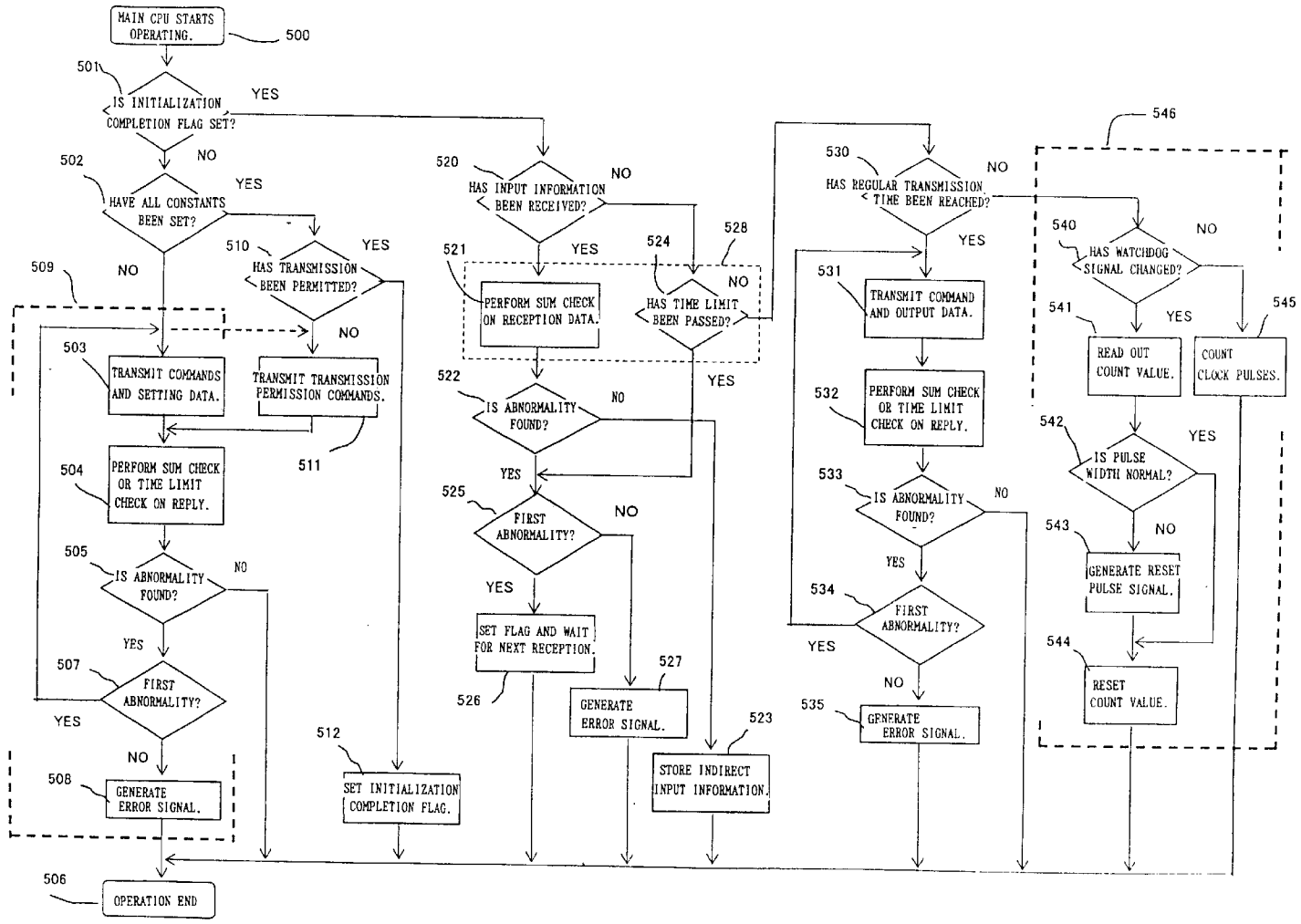
FIG. 5 is a flowchart showing the operation of a main CPU of the vehicular electronic control apparatus of FIG. 1.
Figure 6:
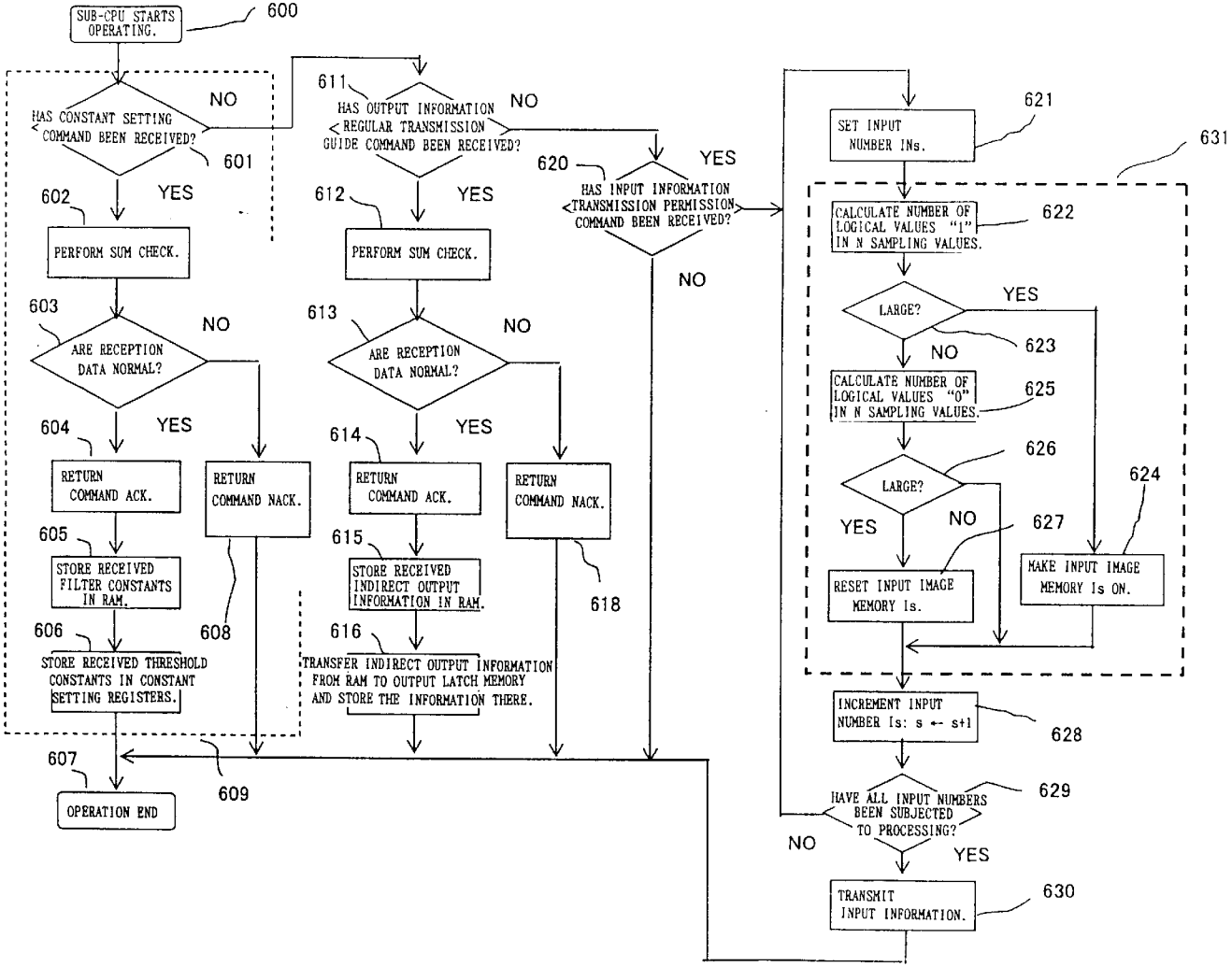
FIG. 6 is a flowchart showing the operation of a sub-CPU of the vehicular electronic control apparatus of FIG. 1.

FIGS. 4(*a*)–4(*e*) show five communication frame structures of the vehicular electronic control apparatus of FIG. 1. FIG. 5 is a flowchart showing the operation of the main CPU 111 of the vehicular electronic control apparatus of FIG. 1. FIG. 6 is a flowchart showing the operation of the sub-CPU 121*a* of the vehicular electronic control apparatus of FIG. 1.

The operation of the vehicular electronic control apparatus according to the first embodiment having the configuration of FIG. 1 will be described below. First, the data transmission frame structures of serial communication shown in FIGS. 4(*a*)–4(*e*) will be described.

FIG. 4(*a*) shows a constant transmission frame structure that is used for transmitting filter constants and threshold constants for on/off signals that are stored in the nonvolatile memory 112*a* to the second RAM 123 or the constant setting registers 134*a* of the first ancillary integrated circuit device 120*a* via the main CPU 111, the first parent station serial/parallel converter 116*a*, the first child station serial/parallel converter 126, and the sub-CPU 121*a*. The top part of FIG. 4(*a*) shows transmission data of the main CPU 111, and the bottom part of FIG. 4(*a*) shows replay data of the other side, that is, reception data of the main CPU 111.

Each frame of each frame structure contains data of 11 bits in total, that is, data of 8 bits, a start bit, a parity bit, and a stop bit.

Sum data frame SUM contains data of 11 bits in total, that is, data of 8 bits that is a vertical bit sum value (i.e., a binary sum value without carrying) of the values of a series of frames, a start bit, a parity bit, and a stop bit.

In FIG. 4(*a*), reference symbol 400*a* denotes a digital constant transmission guide frame structure that consists of a transmission start frame STX (e.g., "55" in hexadecimal notation), a command frame COM1 (e.g., "10" in hexadecimal notation), filter constant frames DF1–DFs corresponding to respective indirect on/off input signals IN1–INs, threshold constant frames DC1–DCr corresponding to respective direct on/off input signals IN1–INr, a transmission end frame ETX (e.g., "AA" in hexadecimal notation), and a sum data frame SUM.

Reference numeral 401 denotes a normal replay frame structure that consists of a transmission start frame STX, a normal reception frame ACK (e.g., "81" in hexadecimal notation), a transmission end frame ETX, and a sum data frame SUM.

If reception data are abnormal, an abnormal reception frame NACK (e.g., "82" in hexadecimal notation) is returned instead of the normal reception frame ACK. When receiving the abnormal reception frame NACK, the main CPU 111 takes a proper measure such as sending the constants again.

FIG. 4(*b*) shows a constant transmission frame structure that is used for transmitting filter constants for analog signals that are stored in the nonvolatile memory 112*a* to the constant setting registers 156*a* of the second ancillary integrated circuit device 140*a* via the main CPU 111, the second parent station serial/parallel converter 116*b*, the second child station serial/parallel converter 146, and the communication control device 141*a*. The top part of FIG. 4(*b*) shows transmission data of the main CPU 111, and the bottom part of FIG. 4(*b*) shows replay data of the other side, that is, reception data of the main CPU 111.

In FIG. 4(*b*), reference symbol 400*b* denotes an analog constant transmission guide frame structure that consists of a transmission start frame STX, a command frame COM1, filter constant frames AF1–AFt corresponding to respective analog input signals AN1–ANt, a transmission end frame ETX, and a sum data frame SUM. A normal replay frame structure 401 corresponding to the analog constant transmission guide frame 400*b* is the same as the counterpart shown in FIG. 4(*a*).

FIG. 4(*c*) shows a digital input information reply guide frame structure 403*a* that is used for transmitting indirect input signals IN1–INs that have been input to the first ancillary integrated circuit device 120*a* to the first RAM 113 via the sub-CPU 121*a*, the first child station serial/parallel converter 126, the first parent station serial/parallel converter 116*a*, and the main CPU 111, as well as an input information transmission permission frame structure 402. The top part of FIG. 4(*c*) shows transmission data of the main CPU 111, and the bottom part of FIG. 4(*c*) shows replay data of the other side, that is, reception data of the main CPU 111.

As shown in FIG. 4(*c*), the input information transmission permission frame structure 402 consists of a transmission start frame STX, a command frame COM2 (e.g., "20" in hexadecimal notation), a transmission end frame ETX, and a sum data frame SUM. If the command frame COM2 is changed to a command frame COM4 (e.g., "40" in hexadecimal notation), an input information transmission prohibition frame is obtained.

Reference numeral 403*a* denotes the digital input information reply guide frame structure 403*a* that consists of a transmission start frame STX, a command frame COM3 (e.g., "30" in hexadecimal notation), digital input frames DI1, DI2, and DI3 that are produced by gathering indirect on/off input signals IN1–INs in units of eight points, a transmission end frame ETX, and a sum data frame SUM.

After the transmission of input information has been permitted by the command COM2, input information is repeated spontaneously and regularly until its transmission is prohibited by the command COM4.

The number of digital input frames varies depending on the number of points of indirect on/off input signals; for practical uses, it is sufficient to set the number of digital input frames to three (24 points).

FIG. 4(*d*) shows an analog input information reply guide frame structure 403*b* that is used for transmitting analog input signals AN1–ANt that have been input to the second ancillary integrated circuit device 140*a* to the first RAM 113 via the communication control circuit 141*a*, the second child station serial/parallel converter 146, the second parent station serial/parallel converter 116*b*, and the main CPU 111, as well as an input information transmission permission frame structure 402. The top part of FIG. 4(*d*) shows transmission data of the main CPU 111, and the bottom part of FIG. 4(*c*) shows replay data of the other side, that is, reception data of the main CPU 111.

In FIG. 4D, the input information transmission permission/prohibition frame structure 402 is the same as shown in FIG. 4(*c*).

The analog input information reply guide frame structure 403*b* consists of a transmission start frame STX, a command frame COM3 (e.g., "30" in hexadecimal notation), digital input frames AI1L, AI1H, . . . , AItL, and AItH that are produced by gathering 10 bits of digital conversion values of each of analog input signals AN1–ANt in units of two bytes, a transmission end frame ETX, and a sum data frame SUM.

After the transmission of input information has been permitted by the command COM2, input information is repeated spontaneously and regularly until its transmission is prohibited by the command COM4.

FIG. 4(*e*) shows an output information transmission guide frame structure 404 that is used for transmitting indirect output information that is stored in the first RAM 113 to the output latch memory 125 of the first ancillary integrated circuit device 120*a* via the main CPU 111, the first parent station serial/parallel converter 116*a*, the first child station serial/parallel converter 126, and the sub-CPU 121*a*. The top part of FIG. 4(*a*) shows transmission data of the main CPU 111, and the bottom part of FIG. 4(*a*) shows replay data of the other side, that is, reception data of the main CPU 111.

As shown in FIG. 4(*e*), the output information transmission guide frame structure 404 consists of a transmission start frame STX, an output information regular transmission guide command frame COM5 (e.g., "50" in hexadecimal notation), digital output frames DO1 and DO2 that are produced by gathering indirect output signals OUT1–OUTn in units of eight points, a transmission end frame ETX, and a sum data frame SUM.

The number of digital output frames following the command COM5 varies depending on the number of indirect output signals OUT1–OUTn. It is sufficient to set the number of digital output frames to two (2 bytes).

A normal replay frame structure 401 is the same as the counterparts shown in FIGS. 4(*a*) and 4(*b*).

Next, the operation of the main CPU 111 shown in FIG. 1 will be described with reference to the flowchart of FIG. 5.

At step 500, the main CPU 111, which is activated on a regular basis, starts operating. At step 501, which is executed after step 500, it is judged whether an initialization completion flag was set at step 512 (described later). At step 502, which is executed when the judgment result at step 501 is "no," it is judged whether all constants for the first and second ancillary integrated circuit devices 120*a* and 140*a* have been set. At step 503, which is executed when the judgment result at step 502 is "no," filter constants and threshold values are transmitted to the first ancillary integrated circuit device 120*a* by using the constant transmission guide frame structures 400*a* and 400*b* shown in FIGS. 4A and 4B. At step 504, which is executed after step 503, a sum check is performed on replay data having the frame structure 401 shown in FIGS. 4(*a*) and 4(*b*) or a time limit check is performed.

At step 504, a sum check is performed on reception data immediately after reception of a reply, if any. If no reply is obtained at step 504 after waiting of a predetermined time, it is judged that the time limit has been passed and the process goes to the next step 505.

At step 505, which is executed after step 504, it is judged whether a sum check error or a time limit passage error has occurred. At step 506, which is an operation end step to be executed when no abnormalities are found at step 505, the operation start step 500 is activated again, whereby the control operation is started again.

When the operation start step 500 is activated again, if the initialization completion flag has not been set at step 512 and not all constants have been set, constants are set for the second ancillary integrated circuit device 140*a* by using the frame structure shown in FIG. 4(*b*) by executing steps 501–505.

On the other hand, if an abnormality is found at step 505, the process goes to step 507, where it is judged whether the abnormality is the first one found so far at step 505. If it is judged that the abnormality is the first one, the process returns to step 503, where the setting data are transmitted again.

If it is judged at step 507 that the abnormality is not the first one, which means that the abnormality is continuing even after transmission of the setting data, the process returns to step 508, where a communication abnormality signal ER1 is generated. The process goes to the operation end step 506.

If it is judged at step 502 during the course of the above operation that all constants have been set, the process goes to step 510.

At step 510, it is judged whether input information transmission permission frames 402 shown in FIGS. 4(*c*) and 4(*d*) have been transmitted. If the input information transmission permission frames 402 have not been transmitted yet, the process goes to step 511 that is a transmission permitting means, where the input information transmission permission frames 402 are transmitted.

Then, steps 504–508 etc. are executed selectively in the same manner as in the case where step 503 is executed. There is an exception: if it is judged at step 507 that the abnormality is the first one, the process returns to step 511 rather than step 503.

If it is judged at step 510 that the input information transmission permission frames 402 have been transmitted to the first and second ancillary integrated circuit devices 120*a* and 140*a*, the process goes to step 512, where the initialization completion flag is set. The process then goes to step 506.

Step 504 is a means for monitoring a communication relating to a reply. A step block 509 consisting of steps 503–508 constitute a constant transfer means.

The communication abnormality signal ER1 of step 508 and the initialization completion flag of step 512 are maintained until re-application of power.

After the setting of all constants has been completed, transmission of input information has been permitted, and the initialization completion flag has been set by the above operation, the process goes from the operation start step 500 to step 520 via step 501.

At step 520, it is judged whether the first and second parent serial/parallel converters 116*a* and 116*b* have received input information reply guide frames 403*a* and 403*b* shown in FIGS. 4C and 4D, respectively. At step 521, which is executed when the judgment result at step 520 is "yes," a sumcheck is performed on the reception data. At step 522, which is executed after step 521, it is judged whether an abnormality is found in the reception data. If an abnormality is found, the process goes to step 525. If the reception data are normal, the process goes to step 523, where the received indirect input information is stored in the first RAM 113.

At step 524, which is executed when the judgment result at step 520 is "no," it is judged whether the data were received after a lapse of a predetermined repetition period T0 (data should be received on a regular basis). If it is judged at step 524 that the time limit was passed, the process goes to step 525. If it is judged that the time limit was not passed, the process goes to step 530.

At step 525, it is judged whether the abnormality that has been found at step 522 or 524 is the first one. If the abnormality is the first one, the process goes to step 526, where first abnormality flag is set. If the abnormality is not the first one, the process goes to step 527, where a communication abnormality signal ER1 is generated.

After the execution of steps 526, 527, or 523, the process goes to step 506, where the operation start step 500 is activated again.

A step block 528 consisting of steps 521 and 524 is a means for monitoring a communication relating to reception of input information.

At step 530, which is executed when it is judged at step 524 that the time limit was not passed, it is judged whether a regular transmission time of indirect output signal has been reached. At step 531, which is executed when the judgment result at step 530 is "yes," indirect output data are transmitted to the latch memory 125 by using the output information transmission guide frame structure 404 shown in FIG. 4(*e*). Step 531 is a regular output data transmitting means.

At step 532, which is executed after step 531, a sum check or a time limit check is performed on reply data. More specifically, at step 532, a sum check is performed on reception data upon reception of a reply, in which case the process goes to the next step 533. If no replies are received by waiting of a prescribed time at step 532, it is judged that the time limit has passed. The process goes to step 533 also in this case.

At step 533, which is executed after step 532, it is judged whether a sum check error or a time limit error occurred at step 532. At step 506, which is executed when no abnormalities are found at step 533, the operation start step is activated again to repeat the control operation again.

On the other hand, if an abnormality is found at step 533, the process goes to step 534, where it is judged whether the abnormality that was found at step 533 is the first one. If it is judged that the abnormality is the first one, the process returns to step 531, where the indirect output data are transmitted again.

If it is judged at step 534 that the abnormality is not the first one, which means that the abnormality is continuing in spite of the re-transmission, the process goes to step 535. At step 535, a communication abnormality signal ER1 is generated. The process then goes to the operation end step 506.

Step 532 is a communication monitoring means for monitoring a reply to output data.

At step 540, which is executed when the judgment result at step 530 is "no," it is judged whether a watchdog signal that is generated by the sub-CPU 121*a* has changed from "H" to "L" or "L" to "H." At step 541, which is executed when it is judged at step 540 that the watchdog signal has changed, a count result of clock pulses that was obtained by counting at step 545 (described later) is read as a pulse width of the watchdog signal. At step 542, which is executed after step 541, it is judged whether the read-out count value exceeds a prescribed value. At step 543, which is executed when it is judged at step 542 that the read-out count value exceeds the prescribed value and hence the pulse width of the watchdog signal is abnormal, a reset pulse signal is generated to reactivate the sub-CPU 121*a*. At step 544, which is executed after step 543 or when it is judged at step 542 that the pulse width of the watchdog signal is normal, the clock pulse count value that was obtained at step 545 is reset. Step 545, which is executed when the judgment result at step 540 is "no," serves as an interrupt counter that counts clock pulses. The interrupt counter 545 measures an "H" pulse width or a "L" pulse width of the watchdog signal.

After the execution of steps 544 or 545, the process goes to step 506, where the operation start step 500 is activated again after a lapse of a prescribed time.

A step block 546 consisting of steps 540–545 is a means for watching for a runaway of the sub-CPU 121*a*.

Next, the operation of the sub-CPU 121*a* will be described with reference to the flowchart of FIG. 6.

At step 600, the sub-CPU 121*a*, which is activated on a regular basis, starts operating. At step 601, which is executed after step 600, it is judged whether a constant transmission guide command COM1 shown in FIG. 4(*a*) has been received. At step 602, which is executed when it is judged at step 601 that the command COM1 has been received, a sum check is performed on all reception frames having the frame structure 400*a* shown in FIG. 4(*a*). At step 603, which is executed after step 602, it is judged whether a sum check result is normal. At step 604, which is executed when it is judged at step 603 that the sum check result is normal, a normal reception command ACK of the frame structure 401 shown in FIG. 4(*a*) is returned. At step 605, which is executed after step 604, received filter constants are stored in the second RAM 123. At step 606, which is executed after step 605, received threshold values are stored in the respective constant setting registers 134*a* via the second RAM 123 (see FIGS. 1 and 2A). At step 607, which is an operation end step that is executed after step 606, the operation start step 600 is activated after a lapse of a prescribed time (every time execution of the series of steps has been completed).

At step 608, which is executed when it is judged at step 603 that an abnormality is found in the reception data, an abnormal reception command NACK is transmitted instead of the normal reception command ACK (see the frame structure 401 shown in FIG. 4(*a*)). The process then goes to step 607.

A step block 609 consisting of steps 601–606 and 608 is a constant receiving means.

At step 611, which is executed when the judgment result at step 601 is "no," it is judged whether an output information regular transmission guide command COM6 shown in FIG. 4(*e*) has been received. At step 612, which is executed when it is judged at step 611 that the command COM& has been received, a sum check is performed on all reception frames having the frame structure 404 shown in FIG. 4(*e*). At step 613, which is executed after step 612, it is judged whether a sum check result is normal. At step 614, which is executed when it is judged at step 613 that the sum check result is normal, a normal reception command ACK of the frame structure 401 is returned. At step 615, which is executed after step 614, received indirect output information is stored in the second RAM 123. At step 616, which is executed after step 615, the indirect output information is transferred from the second RAM 123 to the output latch memory 125 (see FIG. 1) and stored there. At step 607, which is the operation end step that is executed after step 616, the operation start step 600 is activated repeatedly after a lapse of a prescribed time every time execution of the series of steps has been completed.

At step 618, which is executed when it is judged at step 613 that an abnormality is found in the reception data, an abnormal reception command NACK is transmitted instead of the normal reception command ACK (see the frame structure 401 shown in FIG. 4(*e*)). The process then goes to step 607.

At step 620, which is executed when the judgment result at step 611 is "no," it is judged whether an input information transmission permission command COM2 shown in FIG. 4(*c*) has been received. If the judgment result at step 620 is "no," the process goes to the operation end step 607. If the judgment result at step 620 is "yes," the process goes to step 621.

At step 621, an input number INs of a subject variable filter that is implemented by software is set. At step 622, which is executed after step 621, the number of logical values "1" in N sampling values including a value of the latest state among on/off states (logical value "1" or "0") of the input number INs that were sampled sequentially at a preset shift period T is calculated. At step 623, which is executed after step 622, it is judged whether the number of logical values "1" that was calculated at step 622 is large (all the N sampling values have a value "1" or 90% or more, for example, of the N sampling values have a value "1"). If the number of logical values "1" is large, the process goes to the next step 624. At step 624, an input image memory having a number Is in the second RAM 123 is made on. The value of the input image memory Is represents a currently determined on/off state of the input number INs.

At step 625, which is executed when the judgment result at step 623 is "no" (i.e., the number of logical values "1" is not large), the number of logical values "0" in N sampling values including a value of the latest state among the on/off states (logical value "1" or "0") of the input number INs is calculated. At step 626, which is executed after step 625, it is judged whether the number of logical values "0" that was calculated at step 625 is large (all the N sampling values have a value "0" or 90% or more, for example, of the N sampling values have a value "0"). If the number of logical values "0" is large, the process goes to the next step 627. At step 627, the input image memory Is in the second RAM 123 is reset, that is, made off. The value of the input image memory Is represents a currently determined on/off state of the input number INs.

At step 628, the subject input number INs is updated to the next number when the value of the input image memory Is was updated at step 624 or 627 or the judgment results of both of steps 623 and 626 were "no" (i.e., the state is hanging (neither the number of logical values "1" or the number of logical values "0" is large) and the value of the input image memory Is was not changed). At a completion judgment step 629, it is judged whether all the input numbers have been subjected to processing. If the judgment result at step 629 is "no," the process returns to step 621. If all the input numbers have been subjected to processing, the process goes to step 630. At step 630, input information is transmitted to the main memory 111 by using the frame structure 403*a* shown in FIG. 4(*c*). The process goes to the operation end step 607 and then to the operation start step 600.

A step block 631 consisting of steps 622–627 is a variable filter means for one-point on/off input signal.

Usually, steps 623 and 626 as input deciding means may judge whether all the logical values are "1" or "0." In this case, a judgment can be made easily by ANDing the logical values of N sampling points (step 623) or Oring those (step 626).

With the above digital filter means, even when, for example, chattering occurs at an input contact and the input signal state converges to the on state while becoming on and off repeatedly at small intervals, the on and off states that occur at small intervals are rarely sampled. Even if they are sampled, it is not determined that the input signal state is on because they are not such that many consecutive sampling values are on.

In the case of manual switches such as air-conditioner switches, instantaneous switching-on is disregarded, which means that an erroneous operation due to noise can be prevented.

Further, the noise filters 131 and the level judgment comparators 132*b* are provided as input interface circuits to prevent an event that false input signal states happen to occur at consecutive times of sampling due to superimposition of radio-frequency noise (e.g., an on input signal state is erroneously regarded as off due to noise).

Next, based on the description of the operation that has been made above with reference to FIGS. 4(*a*)–4(*e*) to FIG. 6, the operation of the vehicular electronic control apparatus according to the first embodiment shown in FIGS. 1–3 will be summarized.

Referring to FIG. 1, the core integrated circuit device 110*a* of the vehicular electronic control apparatus 100*a* performs control operations using the main CPU 111 and the first nonvolatile memory 112*a*.

Input information for control operations are of the following three systems: direct parallel input signals of on/off operations that are directly bus-supplied to the main CPU 111 via the high-speed input terminals 110*a*, noise filters 131, variable threshold circuits 132*a*, and the data selector 114; indirect parallel input signals of on/off operations that are indirectly bus-supplied to the main CPU 111 via the low-speed input terminals 101*b*, noise filters 131, level judgment comparators 132*b*, data selector 124*b*, the sub-CPU 121*a*, the first child station serial/parallel converter 126, and the first parent station serial/parallel converter 116*a*; and digital conversion values of analog signals that are indirectly bus-supplied to the main CPU 111 via the analog input terminals 102, noise filters 151, variable filter circuits 153*a*, multi-channel A/D converters 154*a* and 154*b*, second child station serial/parallel converter 146, and second parent station serial/parallel converter 116*b*.

On the other hand, output information of control operations are direct parallel output signals that are supplied to the high-speed output terminals 103*a* via the output transistors 108 by the output latch memory 115 that is directly bus-connected to the main CPU 111, and indirect parallel output signals that are supplied to the low-speed output terminals 103*b* by the main CPU 111 via the first parent station serial/parallel converter 116*a*, first child station serial/parallel converter 126, the sub-CPU 121*a*, output latch memory 125, and output transistors 108.

Control programs, various control constants, etc. for the main CPU 111 are stored in advance in the first nonvolatile memory 112*a* by the external tool 106. When practical operation of the vehicular electronic control apparatus 100*a* is started, transfer and writing of filter constants and threshold constants stored in the first nonvolatile memory 112*a* are performed via the first and second parent serial/parallel converters 116*a* and 116*b*.

Threshold constants for the variable threshold circuits 132*a* of the first ancillary integrated circuit device 120*a* are transferred to the constant setting registers 134*a*. Variable filter constants to be used in the variable filter means 631 shown in FIG. 6 are stored in the second RAM 122.

Filter constants for the variable filter circuits 153*a* of the second ancillary integrated circuit device 140*a* are transferred to the constant setting registers 156*a*.

The communication control circuit 141*a* shown in FIG. 3 is bus-connected to the second child station serial/parallel converter 146, the constant setting registers 156*a*, the buffer memories 322 in which pieces of A/D-converted information corresponding to respective analog input signals are stored, and other components. And the communication control circuit 141*a* is hardware having functions of sum-checking transmission/reception data and generating their sum data, chip-selecting one of the various memories in accordance with a command recognition result, constructing frames of reply data, etc. Alternatively, a second sub-CPU for communication control may be provided.

The watchdog timer 129 that is provided in the first ancillary integrated circuit device 120*a* monitors the pulse width of a watchdog signal WD1 that is a pulse train generated by the main CPU 111. If the pulse width of the watchdog signal WD1 exceeds a prescribed value, the watchdog timer 129 supplies a reset pulse signal RST1 to the main CPU 111 to reactivate it.

On the other hand, the main CPU 111 monitors the pulse width of a watchdog signal WD2 that is a pulse train generated by the sub-CPU 121*a*. If the pulse width of the watchdog signal WD2 exceeds a prescribed value, the main CPU 111 supplies a reset pulse signal RST2 to the sub-CPU 121*a* to reactivate it.

Further, the sub-CPU 121*a* captures digital conversion values of particular analog input signals from the digital conversion output circuit 145 of the second ancillary integrated circuit device 140*a* via the monitoring digital conversion input circuit 124*c* of the first ancillary integrated circuit device 120*a*, and can use those digital conversion values for monitoring control (described later).

Part of high-speed input signals captured from the monitoring parallel input circuit 124*a* by the sub-CPU 121*a* are used for checking, for example, whether an disconnection or short-circuiting abnormality is not found in the input switch circuits.

The vehicular electronic control apparatus according to the first embodiment is provided with the core integrated circuit device including the microprocessor, the first ancillary integrated circuit device for low-speed digital input signals that is serially connected to the core integrated circuit device, and the second ancillary integrated circuit device for analog input signals. Therefore, not only can the core integrated circuit device be standardized even in the case where the number of control input and output points varies with a vehicle type as a control object, but also the speed of exchange of input and output information can be increased by decreasing the degree of congestion of communication lines by means of the double serial communication lines that are separated into the analog system and the digital system. This provides an advantage that the development of the core integrated circuit device which requires a long development period and an enormous cost to satisfy a specification of high operation speeds, high performance, and multi-functionality can be facilitated.

The first ancillary integrated circuit device is equipped with the indirect parallel output circuit. This provides an advantage that the number of control output pins of the core integrated circuit device can be decreased and hence the core integrated circuit device can further be miniaturized and standardized.

The core integrated circuit device and the first or second ancillary integrated circuit device are provided with mutual monitoring means. This provides an advantage that the safety is improved though the use of the separated integrated circuit devices that are connected to each other by the serial communication circuits is, in itself, a factor of increasing the probability of occurrence of a noise-induced erroneous operation.

Further, a noise filter and a level judgment comparator as well as a software-implemented variable filter means are provided in each input circuit section of the parallel input circuit of the first ancillary integrated circuit device. Therefore, filter circuits having a sufficient smoothing function can be formed by using small-capacitance capacitors that can be incorporated in the integrated circuit device and their filter constants can be changed easily. This results in an advantage that the input circuit sections can be miniaturized and standardized.

The first ancillary integrated circuit device has the input interface circuits and the variable threshold circuits immediately upstream of the direct parallel input circuit of the core integrated circuit device. Therefore, equivalent variable filters are formed for the high-speed operation direct parallel input circuit though they are effective only in limited ranges and their filter constants can be changed easily. This results in an advantage that the input circuit sections can be miniaturized and standardized.

Each channel input circuit section of the multi-channel A/D converters provided in the second ancillary integrated circuit device has a noise filter and a variable filter circuit. Therefore, filter circuits having a sufficient smoothing function can be formed by using small-capacitance capacitors that can be incorporated in the integrated circuit device and their filter constants can be changed easily. This results in an advantage that the input circuit sections can be miniaturized and standardized.

Further, the first nonvolatile memory of the core integrated circuit device contains control constants and constant transfer programs that were transferred from the external tool and written to the first nonvolatile memory. This provides advantages that control programs, control constants, filter constants, threshold constants, etc. for various vehicle types can be managed in a unified manner and filter constants and threshold constants can be changed easily.

Figure 7:
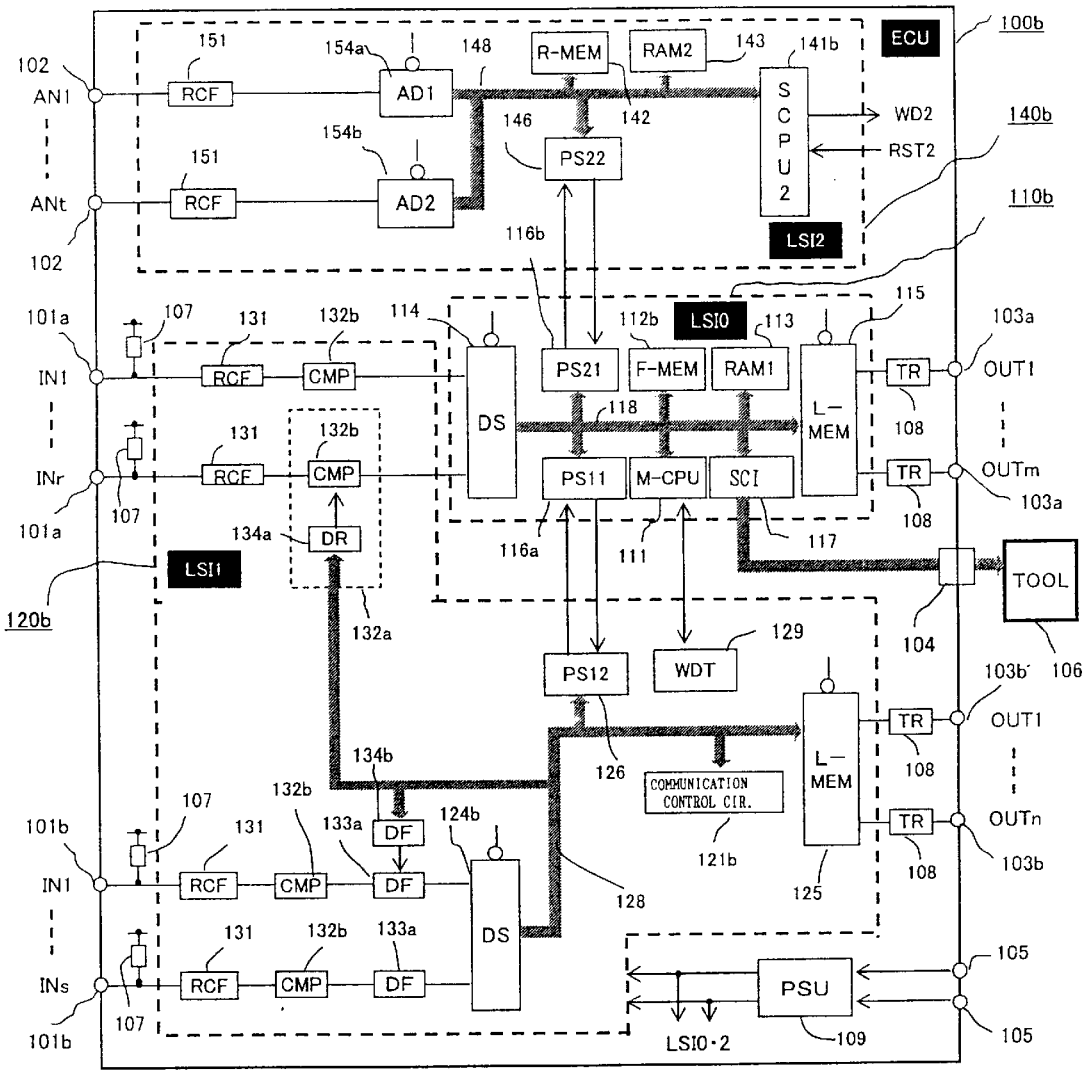
FIG. 7 is a block circuit diagram of a vehicular electronic control apparatus according to a second embodiment of the invention.

Second Embodiment (1) Detailed Description of Configuration of Second Embodiment A vehicular electronic control apparatus according to a second embodiment of the invention will be described below with reference to FIG. 7 mainly for its differences from the vehicular electronic control apparatus according to the first embodiment shown in FIG. 1. FIG. 7 is a block circuit diagram of the vehicular electronic control apparatus according to the second embodiment.

In FIG. 7, reference symbol 100*b* denotes an ECU (vehicular electronic control apparatus) for controlling devices to be controlled. The ECU 100*b* is a single electronic circuit board having, as major parts, a core integrated circuit device 110*b*, a first ancillary integrated circuit device 120*b*, and a second ancillary integrated circuit device 140*b*.

The core integrated circuit device 110*b* is configured in the same manner as the core integrated circuit device 110*a* shown in FIG. 1 except that the main CPU (microprocessor) 111 of the core integrated circuit device 110*b* cooperates with the first nonvolatile memory 112*b*.

In the first ancillary integrated circuit device 120*b*, a hardware-implemented communication control circuit 121*b* is provided in place of the sub-CPU 121*a* of the first ancillary integrated circuit device 120*a* shown in FIG. 1 and the second nonvolatile memory 122, the second RAM 123 for computation, the input data selector 124*a* as the parallel input circuit for monitoring, the input data selector 124*c* as the digital conversion input circuit for monitoring, etc. are removed.

Reference symbol 133*a* denotes hardware-implemented variable filter circuits (described later in detail with reference to FIG. 8) and reference symbol 134*b* denotes constant setting registers for setting filter constants in the variable filter circuits 133*a*, respectively.

In the second ancillary integrated circuit device 140*b*, a sub-CPU 141*b*, a second nonvolatile memory 142, a second RAM 143 are provided in place of the communication control circuit 141*a* of the second ancillary integrated circuit device 140*a* and variable filter means 917 (described later in detail with reference to FIG. 9) are provided in place of the hardware-implemented variable filter circuits 153*a*.

The main CPU 111 monitors the pulse width of a watchdog signal WD2 generated by the sub-CPU 141*b*. If the pulse width of the watchdog signal WD2 exceeds a prescribed value, the main CPU 111 supplies a reset pulse signal RST2 to the sub-CPU 141*b* to reactivate it.

Figure 8:
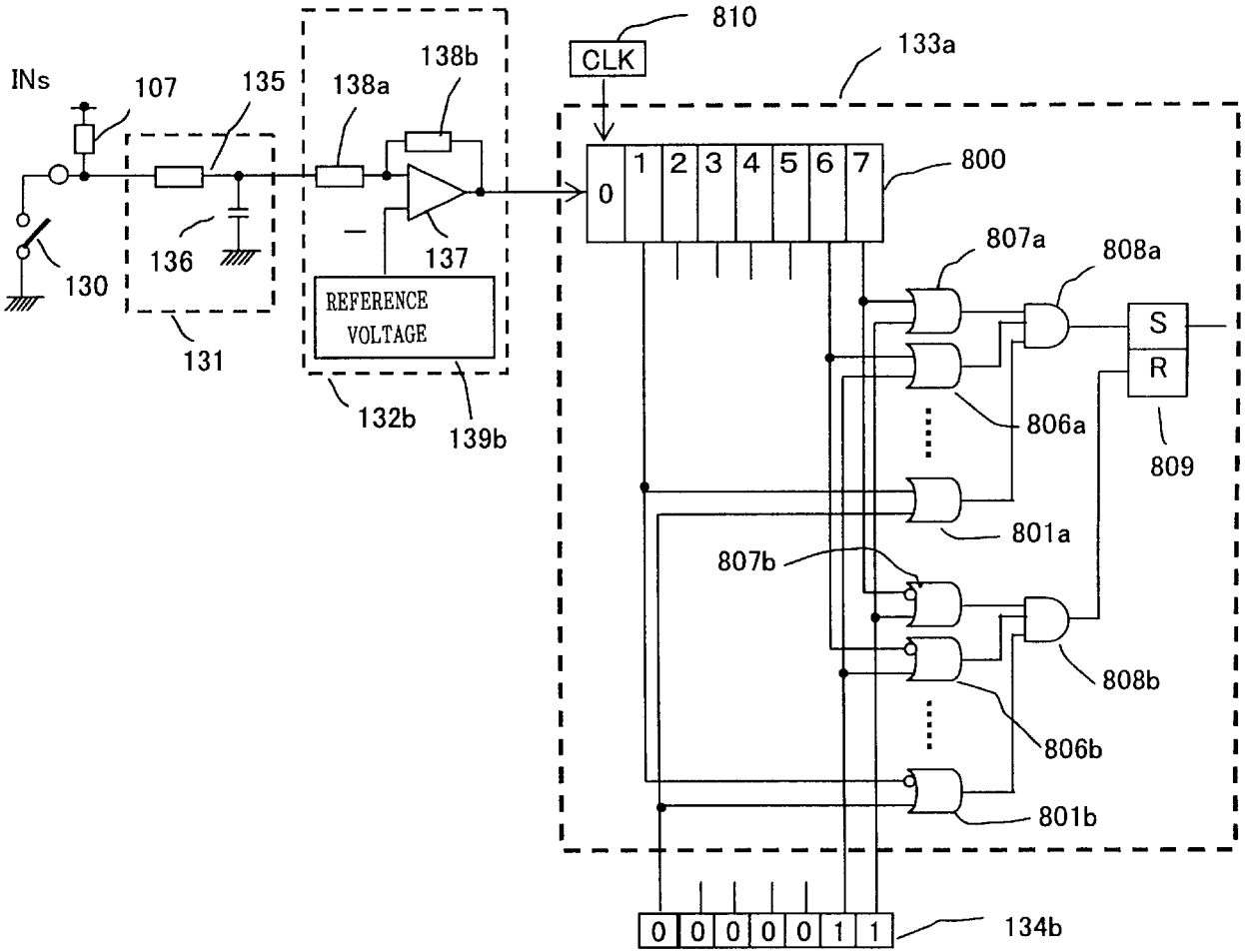
FIG. 8 shows a digital variable filter circuit of the vehicular electronic control apparatus of FIG. 7.

FIG. 8 shows a digital variable filter circuit of the vehicular electronic control apparatus of FIG. 7.

As shown in FIG. 8, a small-resistance bleeder resistor 107 is provided for an input switch 103. An input signal INs is supplied to a small-capacitance (e.g., tens of picofarads) parallel capacitor 136 via a large-resistance (e.g., hundreds of kilo-ohms that is a practicable upper limit value) series resistor 135.

Reference numeral 131 denotes a noise filter that is composed of the series resistor 135 and the small-capacitance capacitor 136. The noise filter smoothes out a signal by absorbing radio-frequency noise.

Reference symbol 132*b* denotes a level judgment comparator 132*b* that is composed of an input resistor 138*a*, a positive feedback resistor 138*b*, and a comparator 137. A prescribed reference voltage 139*b* (voltage Vo) is applied to the inverting input terminal of the comparator 137.

Therefore, if the voltage across the small-capacitance capacitor 136 becomes higher than the reference voltage Von, a voltage "H" (logical value "1") appears at the output of the comparator 137. However, once the output voltage of the comparator 137 has become "H," addition of a voltage that is fed back by the positive feedback resistor 138*b* occurs at the positive-side input terminal of the comparator 137 and hence the output voltage of the comparator 137 does not become "L" (logical value "0") unless the voltage across the small-capacitance capacitor 136 becomes lower than Voff (<Von). A hysteresis function is thus realized.

This is to prevent the output voltage of the comparator 137 from being inverted at a high frequency due to a noise ripple that is superimposed on the voltage across the small-capacitance capacitor 136.

A shift register 800 of a variable filter circuit 133*a* is supplied with an output signal of the comparator 137 and is also supplied with a shift pulse signal having a period T by a clock generator 810.

Therefore, the stages of the shift register 800 have logical values that were output from the comparator 137 in order.

Reference symbols 801*a*–807*a* denote first logic gate elements each of which calculates the OR of the logical value of the associated output stage of the shift register 800 and the logical value of the associated bit of the constant setting register 134*b*. Reference symbol 808*a* denotes an AND element that combines the outputs of the first logic gate elements 801*a*–807*a*. Reference numeral 809 denotes an input determination flip-flop circuit that is a flip-flop element that is set by an output signal of the AND element 808*a*.

Reference symbols 801*b*–807*b* denote second logic gate elements each of which calculates the OR of the negated value of the logical value of the associated output stage of the shift register 800 and the logical value of the associated bit of the constant setting register 134*b*. Reference symbol 808*b* denotes an AND element that combines the outputs of the second logic gate elements 801*b*–807*b*. The input determination flip-flop circuit 809 is reset by an output signal of the AND element 808*b*.

In the variable filter circuit 133*a* having the above configuration, if all the output stages of the shift register 800 have a logical value "1," the input determination flip-flop circuit 809 is set so as to have an output logical value "1" by an output signal of the AND element 808*a*.

However, if part of the constant setting registers 134*b* have a logical value "1," the associated output stages of the shift register 800 may have a logical value "0."

Therefore, in the example of FIG. 8, if all of the first to fifth stages of the shift register 800 have a logical value "1," the input determination flip-flop circuit 809 is set so as to have an output logical value "1."

If all of the output stages of the shift register 800 have a logical value "0," the input determination flip-flop circuit 809 is reset so as to have an output logical value "0."

However, if part of the constant setting registers 134*b* have a logical value "1," the associated output stages of the shift register 800 may have a logical value "1."

Therefore, in the example of FIG. 8, if all of the first to fifth stages of the shift register 800 have a logical value "0," the input determination flip-flop circuit 809 is reset so as to have an output logical value "0."

As described above, the number of logical judgment points for determination of an output value of the input determination flip-flop circuit 809 can be set variably by the contents of the constant setting register 134*b*.

Instead of variably setting the number of logical judgment points in the above manner, the pulse period of the clock generator 810 may be set variably.

(2) Detailed Description of Operation of Second Embodiment

Figure 9:
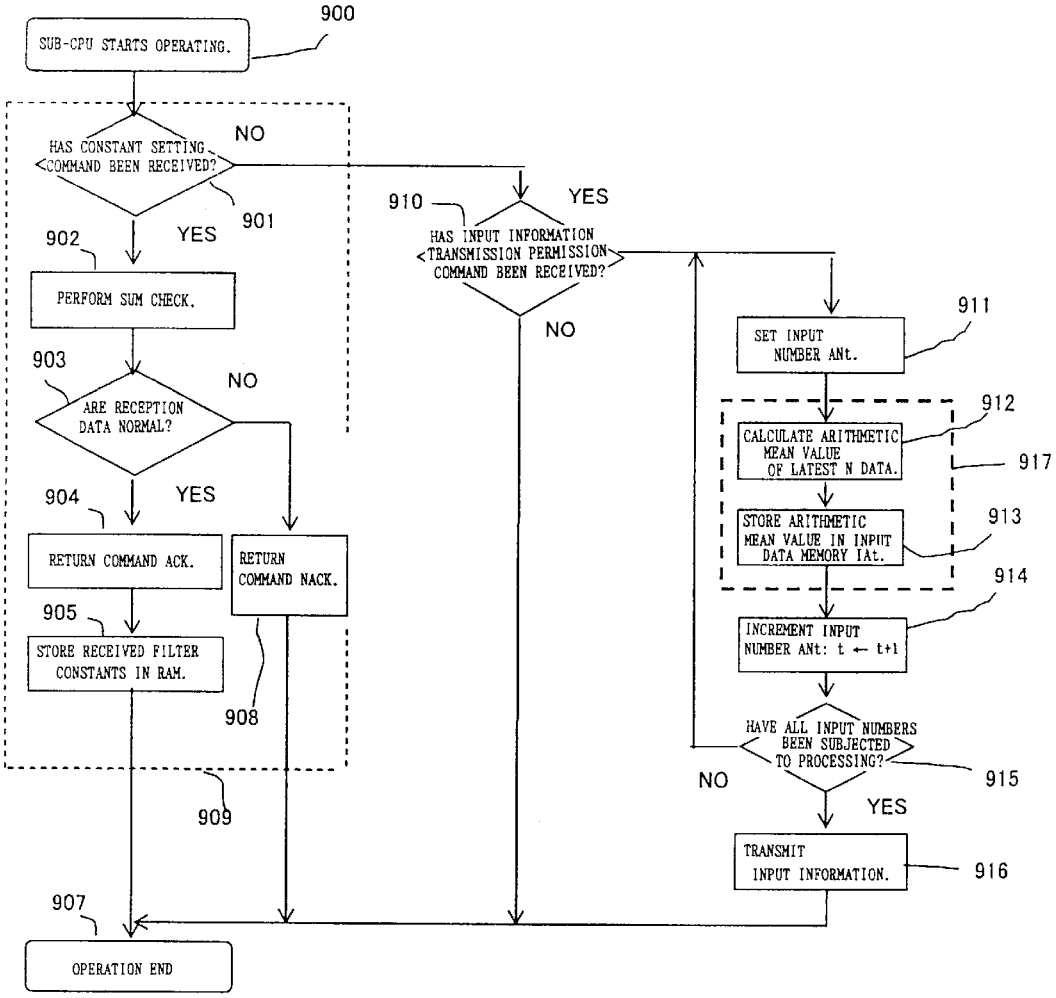
FIG. 9 is a flowchart showing the operation of a sub-CPU of the vehicular electronic control apparatus of FIG. 7.

FIG. 9 is a flowchart showing the operation of the sub-CPU 141*b* of the vehicular electronic control apparatus of FIG. 7.

Referring to FIG. 9, at step 900, the sub-CPU 141*a*, which is activated on a regular basis, starts operating. At step 901, which is executed after step 900, it is judged whether a constant transmission guide command COM1 shown in FIG. 4B has been received. At step 902, which is executed when it is judged at step 901 that the command COM1 has been received, a sum check is performed on all reception frames having the frame structure 400*b* shown in FIG. 4B. At step 903, which is executed after step 902, it is judged whether a sum check result is normal. At step 904, which is executed when it is judged at step 903 that the sum check result is normal, a normal reception command ACK of the frame structure 401 shown in FIG. 4B is returned. At step 905, which is executed after step 904, received filter constants are stored in the second RAM 143. At step 907, which is an operation end step that is executed after step 905, the operation start step 900 is activated after a lapse of a prescribed time (every time execution of the series of steps has been completed).

At step 908, which is executed when it is judged at step 903 that an abnormality is found in the reception data, an abnormal reception command NACK is transmitted instead of the normal reception command ACK (see the frame structure 401 shown in FIG. 4B). The process then goes to step 907.

A step block 909 consisting of steps 901–905 and 908 is a constant receiving means.

At step 910, which is executed when the judgment result at step 901 is "no," it is judged whether an input information transmission permission command COM2 shown in FIG. 4D has been received. If the judgment result at step 910 is "no," the process goes to the operation end step 907. If the judgment result at step 910 is "yes," the process goes to step 911.

At step 911, an input number ANt of a subject variable filter is set. At step 912, which is executed after step 911, the arithmetic mean value of digital values of N latest points that were sampled sequentially at a preset shift period T is calculated. At step 913, which is executed after step 912, the arithmetic mean value that was calculated at step 912 is determined as a current digital value and stored in an input data memory IAt in the second RAM 143. At step 914, which is executed after step 913, the next input number INs is determined. At step 915, which is executed after step 914, it is judged whether all the input numbers have been subjected to processing. If the judgment result at step 915 is "no," the process returns to step 911. If all the input numbers have been subjected to processing, the process goes, via step 916, to step 907 from which the process goes to the operation start step 900.

At step 916, digital conversion values of analog input signals are transmitted to the first RAM 113 via the second child station serial/parallel converter 146 and the second parent station serial/parallel converter 116*b* by using the reply frame structure 403*b* shown in FIG. 4(*d*).

A step block 917 consisting of steps 912 and 913 is a variable filter means. The input data memory IAt has a moving average value that is updated every sampling operation.

The noise filters 151 are provided as input interface circuits to prevent each sampling value from having an abnormal value due to noise.

The above variable filter means 917 and variable filter circuit 133*a* have a function that is equivalent to a function that would be obtained by a noise filter consisting of a resistor and a large-capacitance capacitor. Large-capacitance capacitors are not suitable for use in integrated circuits and cause difficulties in changing their capacitance values for each vehicle to be controlled. In view of this, in the second embodiment, the analog variable filters are formed by software of the sub-CPU 141*b*.

The operation of the vehicular electronic control apparatus according to the second embodiment shown in FIGS. 7 and 8 will be summarized below based on the description of the operation that has been made above with reference to FIGS. 4(*a*) and 4(*d*) and FIG. 9. In the vehicular electronic control apparatus of FIG. 7, the sub-CPU 141*b* is provided in the second ancillary integrated circuit device 140*b* rather than the first ancillary integrated circuit device 120*b*.

Therefore, the first ancillary integrated circuit device 120*b* has the hardware-implemented communication control circuit 121*b* and the variable filters for on/off input signals are changed from software means to hardware circuits.

Conversely, the second ancillary integrated circuit device 140*b* has the sub-CPU 141*b* and the variable filters for analog input signals are changed from hardware circuits to software means.

Since the first ancillary integrated circuit device 120*b* does not have a sub-CPU, it is not provided with such monitoring input circuits as the monitoring parallel input circuit 124*a* and the monitoring digital conversion input circuit 124*c*. However, for the other input/output control operations, the first ancillary integrated circuit device 120*b* operates in the same manner as the counterpart shown in FIG. 1.

In the second embodiment, the second ancillary integrated circuit device has the sub-microprocessor to which the second nonvolatile memory and the second RAM for computation are bus-connected and a noise filter and a software-implemented variable filter means are provided in each channel input circuit section of the multi-channel A/D converters of the second ancillary integrated circuit. Therefore, filter circuits having a sufficient smoothing function can be formed by software by using small-capacitance capacitors that can be incorporated in the integrated circuit device and their filter constants can be changed easily. This results in an advantage that the input circuit sections can be miniaturized and standardized.

Third Embodiment

Figure 10:
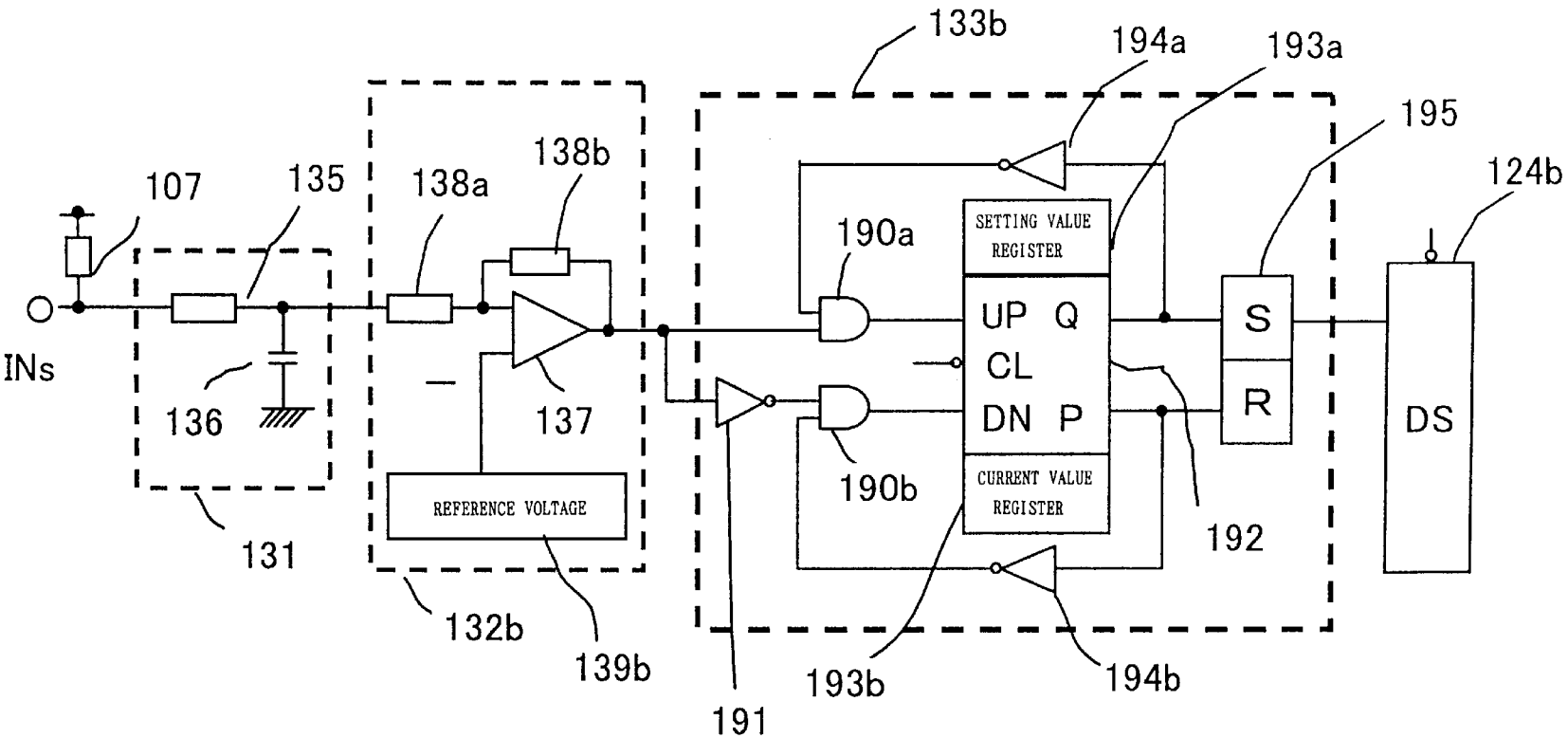
FIG. 10 shows a digital variable filter circuit of a vehicular electronic control apparatus according to a third embodiment of the invention.

Variable filter circuits for on/off signals that are used in a vehicular electronic control apparatus according to a third embodiment of the invention will be described below with reference to FIG. 10. FIG. 10 shows a digital variable filter circuit used in the vehicular electronic control apparatus according to the third embodiment.

In FIG. 10, the noise filter 131 and the level judgment comparator 132*b* are configured and operates in the same manners as those shown in FIG. 8.

Reference numeral 190*a* denotes a gate element that is provided between the output of the comparator 137 and a count-up mode input UP of a reversible counter 192. Reference numeral 191 denotes a negation element that is provided between the output of the comparator 137 and a gate element 190*b*, which is connected to a count-down mode input DN of the reversible counter 192. Having a clock input terminal CL to which an on/off clock signal having a prescribed sampling period T, the reversible counter 192 counts input clock pulses in accordance with the states of the mode inputs UP and DN.

Reference symbol 193*a* denotes a setting value register in which a setting value corresponding to the number N of logical judgment points is stored. Reference symbol 193*b* denotes a current value register in which a current value of the reversible counter 192 is stored. Reference symbol 194*a* denotes a negation element that closes the gate element 190*a* by an output signal Q that is given a logical value "1" when the current value of the reversible counter 912 has reached the setting value, and thereby prevents further counting-up. Reference symbol 194*b* denotes a negation element that closes the gate element 190*b* by an output signal P that is given a logical value "1" when the current value of the reversible counter 912 has becomes "0," and thereby prevents further counting-down. Reference numeral 195 denotes an input determination flip-flop that is set by a setting-value-reached output signal Q and is reset by an output signal P that is given a logical value "1" when the current value has become "0." The output of the input determination flip-flop 195 is connected to the input terminal of the data selector 124*b*.

In the reversible counter 192 having the above configuration, the input determination flip-flop 195 is set if the output value of the comparator 137 has been "H" continuously until the number of clock pulses (having the sampling period T) that have been input to the clock input terminal CL reaches the setting value N of the setting value register 193*a*. If the output value of the comparator 137 turns "L" halfway, the reversible counter 192 counts down the number of input clock pulses. If the output value of the comparator 137 becomes "H" again, the reversible counter 192 counts up the number of input clock pulses. When the current value reaches the setting value during the course of the counting, the input determination flip-flop 195 is set.

Similarly, the input determination flip-flop 195 is reset if the output value of the comparator 137 has been "L" continuously until the current value is decreased to 0 by clock pulses (having the sampling period T) that have been input to the clock input terminal CL. If the output value of the comparator 137 turns "H" halfway, the reversible counter 192 counts up the number of input clock pulses. If the output value of the comparator 137 becomes "L" again, the reversible counter 192 counts down the number of input clock pulses. When the current value reaches 0 during the course of the counting, the input determination flip-flop 195 is reset.

According to the third embodiment, the variable filter circuits of the first ancillary integrated circuit device can be formed by using reversible counters.

Fourth Embodiment

Figure 11:
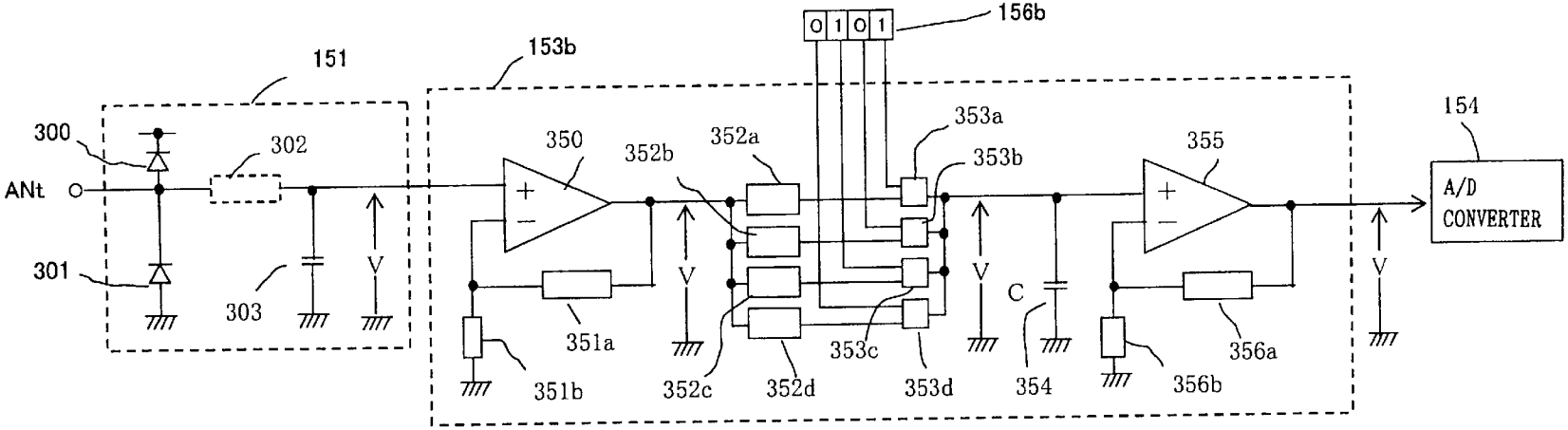
FIG. 11 shows an analog variable filter circuit of a vehicular electronic control apparatus according to a fourth embodiment of the invention.

Variable filter circuits for analog signals that are used in a vehicular electronic control apparatus according to a fourth embodiment of the invention will be described below with reference to FIG. 11. FIG. 11 shows an analog variable filter circuit used in the vehicular electronic control apparatus according to the fourth embodiment.

In FIG. 11, reference numeral 151 denotes a noise filter for an analog input signal ANt, which is composed of a positive-side clip diode 300, a negative-side clip diode 301, a series resistor 302, and a small-capacitance parallel capacitor 303.

The clip diodes 300 and 301 prevent a voltage that is higher than an assumed maximum value of the analog input signal ANt or lower than its assumed minimum value from being applied to the small-capacitance capacitor 303 when large noise is superimposed on the analog input signal ANt, by returning the noise to the positive or negative side of the power supply.

Where an analog sensor that is connected to the terminal for the analog input signal ANt has a proper internal resistance, the series resistor 302 may be omitted.

Reference symbol 153*b* denotes a variable filter circuit. A capacitor 354 (having a capacitance C) that is provided in the variable filter circuit 153*b* is charged via selection switching resistors 352*a*–352*d* and analog gate switches 353*a*–353*d* whose conduction is controlled by a constant setting register 156*b*. A voltage V1', which is produced by amplifying a voltage V1 across the small-capacitance capacitor 303 by an amplifier 350, serves to charge the capacitor 354.

The voltage V2 across the capacitor 354 is output via an amplifier 355 and converted into a digital value by a multi-channel A/D converter 154.

Reference symbols 351*a* and 351*b* denote feedback resistors for feeding back an output signal of the amplifier 350 to its inverting input terminal, and reference symbols 356*a* and 356*b* denote feedback resistors for feeding back an output signal of the amplifier 355 to its inverting input terminal.

Therefore, the variable filter circuit having the above configuration is equivalent to an RC filter consisting of the capacitor 354 (capacitance: C) and a parallel combined resistor (resistance: R0) of part of the selection switching resistors 352*a*–352*d* that are connected to ones that are turned on of the analog gate switches 353*a*–353*d*. The parallel combined resistance R0 can be set variably in accordance with the contents of the constant setting register 156*b*.

According to the fourth embodiment, analog variable filter circuits of the second ancillary integrated circuit device can be formed in the above-described manner.

Fifth Embodiment (1) Detailed Description of Configuration of Fifth Embodiment

Figure 12:
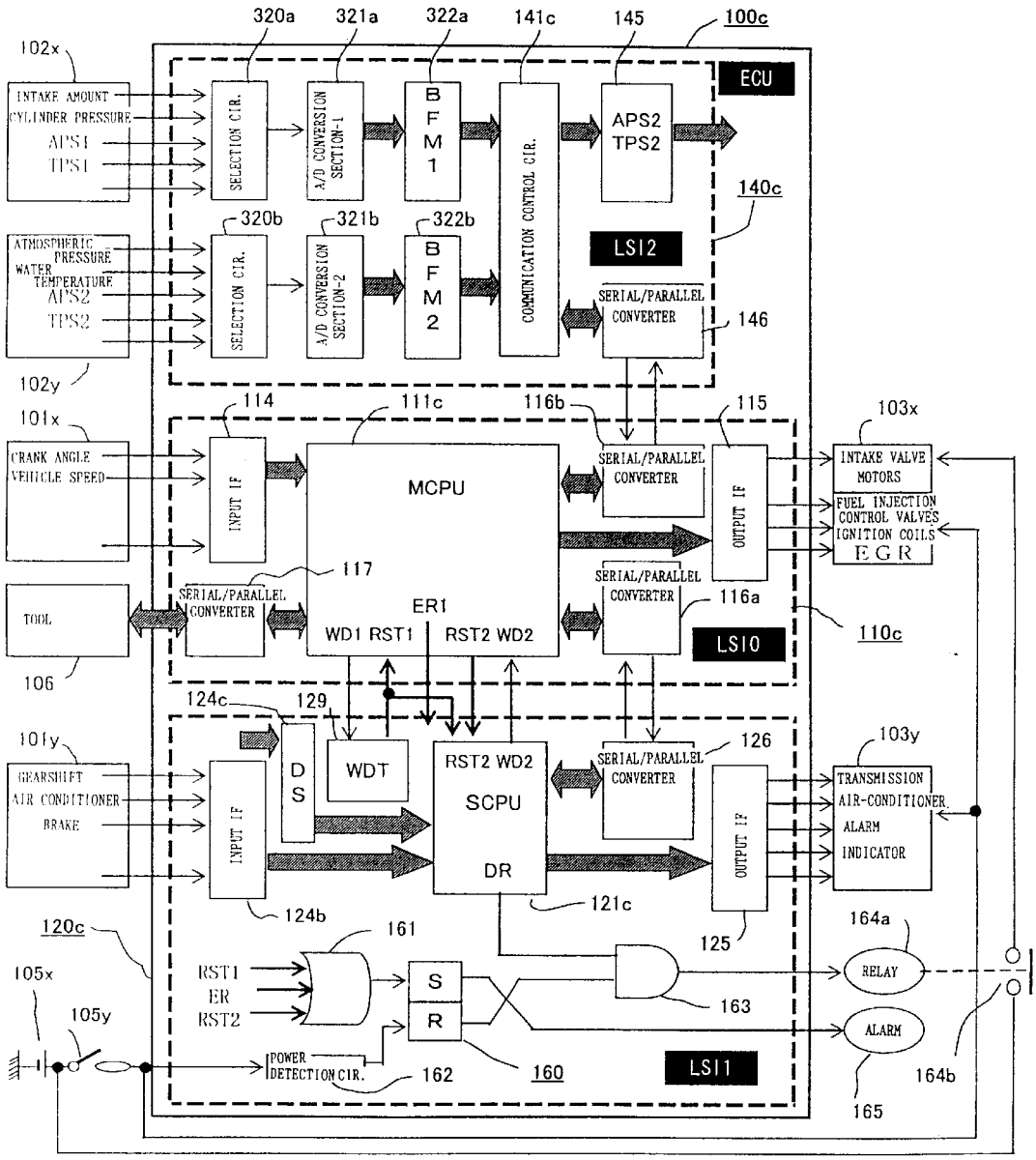
FIG. 12 is a block circuit diagram of a vehicular electronic control apparatus according to a fifth embodiment of the invention.

A vehicular electronic control apparatus according to a fifth embodiment of the invention will be described below with reference to FIG. 12 mainly for its differences from the vehicular electronic control apparatus according to the first embodiment shown in FIG. 1. FIG. 12 is a block circuit diagram of the vehicular electronic control apparatus according to the fifth embodiment.

In FIG. 12, reference symbol 100*c* denotes an ECU (vehicular electronic control apparatus) for controlling devices to be controlled. The ECU 100*c* is a single electronic circuit board having, as major parts, a core integrated circuit device 110*c*, a first ancillary integrated circuit device 120*c*, and a second ancillary integrated circuit device 140*c*. The ECU 100*c* is different from the ECU 100*a* of FIG. 1 in that the former does not have variable filter circuits and mutual watching for an abnormality and an abnormality storage circuit are given importance in the former.

Reference symbol 101*x* denotes high-speed input sensors of on/off operations that are operations of relatively high frequencies performed by such devices as a crank angle sensor for control of engine igniting timing and fuel injection timing and a vehicle speed sensor for auto-cruise control, and that require quick capture of signals.

Reference numeral 101*y* denotes low-speed input sensors of on/off operations that are operations of relatively low frequencies performed by such devices as a selector switch for detecting a gearshift position and an air-conditioner switch, and with which delay in signal capturing causes no serious problems.

Reference symbol 102*x* denotes first analog input sensors such as an intake amount sensor, a cylinder pressure sensor, a first throttle position sensor for detecting the degree of opening of intake valves, and a first accelerator position sensor for detecting the degree of a press on an accelerator. Reference symbol 102*y* denotes second analog input sensors such as an atmospheric pressure sensor, a water temperature sensor, an exhaust gas oxygen concentration sensor, a second throttle position sensor for detecting the degree of opening of the intake valves, and a second accelerator position sensor for detecting the degree of a press on the accelerator. Each of a pair of first and second accelerator position sensors and a pair of first and second throttle position sensors are double-system sensors that generate the same detection output signal.

Reference symbol 103*x* denotes output high-speed electric loads of on/off operations that are operations of relatively high frequencies such as driving of engine ignition coils (in the case of a gasoline engine), driving of solenoid-controlled valves for fuel injection control, and driving of motors for opening and closing intake throttle valves, and that require generation of drive output signals without delay.

Reference symbol 103*y* denotes output low-speed electric loads of on/off operations that are operations of relatively low frequencies such as driving of a solenoid-controlled valve for a transmission and driving of an electromagnetic clutch for the air-conditioner, and with which response delay of drive output signals causes no serious problems.

Reference numerals 105*x* and 105*y* denote a vehicle battery and a power switch, respectively. The vehicular electronic control apparatus 100*c* is supplied with power by the vehicle battery 105*x* via the power switch 105*y* as well as supplied with power (sleep power) directly without intervention of the power switch 105*y*.

Equipped with a main CPU (microprocessor) 111*c* having a first nonvolatile memory and a first RAM for computation (both not shown), the core integrated circuit device 110*c* responds to input signals coming from the various input sensors 101*x*, 101*y*, 102*x*, and 102*y* and controls the various electric loads 103*x* and 103*y* that are devices to be controlled.

A watchdog signal WD1 that is a pulse train generated by the main CPU 111*c* is monitored by a watchdog timer 129 (described later). If the pulse width of the watchdog signal WD1 has exceeded a prescribed value, the watchdog timer 129 reactivates the main CPU 111*c* as well as a sub-CPU 121*c* (described later) by a reset signal RST1.

A watchdog signal WD2 that is a pulse train generated by the sub-CPU 121*c* (described later) is monitored by the main CPU 111*c*. If the pulse width of the watchdog signal WD2 has exceeded a prescribed value, the main CPU 111*c* reactivates the sub-CPU 121*c* by a reset signal RST2.

Further, the main CPU 111*c* detects a communication abnormality in the first and second ancillary integrated circuit devices 120*c* and 140*c* and generates an error signal ER1 that is the OR of error signals that are generated at steps 508, 527, and 535 shown in FIG. 5.

The first ancillary integrated circuit device 120*c* incorporates the watchdog timer 129. Further, equipped with the sub-CPU (microprocessor) 121*c* having a second nonvolatile memory and a second RAM (both not shown), the first ancillary integrated circuit device 120*c* transmits, to the main CPU 111*c*, on/off signals that are received from the low-speed input sensors 101*y* and drives the low-speed electric loads 103*y* using control signals that are supplied from the main CPU 111*c*.

The sub-CPU 121*c* monitors part of digital conversion values of analog input signals that are supplied from an input data selector 124*c* that is a monitoring digital conversion input circuit, and cooperates with the main CPU 111*c* to generate a power relay drive signal DR for particular loads.

Reference numeral 160 denotes an abnormality storage circuit that is a flip-flop circuit. Reference numeral 161 denotes an OR element for ORing reset signals RST1 and RST2 and an error signal ER1. The OR element 161 sets the abnormality storage circuit 160 when a reset signal RST1 or RST2 or an error signal ER1 has occurred.

Reference numeral 162 denotes a power detection circuit that resets and initializes the abnormality storage circuit 160 upon detecting closure of the power switch 105*y*.

Reference numeral 163 denotes a gate element that is a logic circuit provided between the power relay drive output terminal DR and a load power relay 164*a*, and reference numeral 164*b* denotes an output contact of the load power relay 164*a*. The reset output terminal of the abnormality storage circuit 160 is connected to the gate element 163, and the output contact 164*b* is part of a power supply circuit leading to the motors for controlling the degree of opening of the intake valves.

An abnormality alarm device 165 is connected to the set output terminal of the abnormality storage circuit 160.

In the second ancillary integrated circuit device 140*c*, reference symbol 320*a* denotes a selection circuit such as a 16-channel analog switch that selects, one by one, analog input signals of the first analog input sensors 102*x*. Reference symbol 321*a* denotes an A/D conversion section of a sequential-conversion-type, 16-channel/10-bit A/D converter. Reference numeral 322*a* denotes a 10-bit/16-point buffer memory to which digital values obtained by the A/D conversion section 321*a* are input sequentially. Reference numeral 320*b* denotes a selection circuit such as a 16-channel analog switch that selects, one by one, analog input signals of the second analog input sensors 102*y*. Reference symbol 321*b* denotes an A/D conversion section of a sequential-conversion-type, 16-channel/10-bit A/D converter. Reference numeral 322*b* denotes a 10-bit/16-point buffer memory to which digital values obtained by the A/D conversion section 321 bare input sequentially. Reference numeral 141*c* denotes a communication control circuit, which sends digital conversion values of analog input signals that are stored in the buffer memories 322*a* and 322*b* to the main CPU 111*c* via the second child station serial/parallel converter 146 and the second parent station serial/parallel converter 116*b*.

Digital conversion values of part of the analog input signals are also supplied to the sub-CPU 121*c* via a digital conversion output circuit 145 and the monitoring digital conversion input circuit 124*c* of the first ancillary integrated circuit device 120*c*.

(2) Detailed Description of Operation of Fifth Embodiment

In the vehicular electronic control apparatus 100*c* having the above configuration, the core integrated circuit device 110*c* (actually the main CPU 111*c* and the first nonvolatile memory (not shown)) performs control operations while performing serial communications relating to input and output signals with the first and second ancillary integrated circuit devices 120*c* and 140*c*.

Input information for the control operations is input from the high-speed input sensors 101*x*, low-speed input sensors 101*y*, first analog input sensors 102*x*, and second analog input sensors 102*y*, and output information of the control operations is output to the high-speed electric loads 103*x* and the low-speed electric loads 103*y*.

On the other hand, the main CPU 111*c* watches for a runaway of the sub-CPU 121*c* using a watchdog signal WD2. Upon occurrence of an abnormality, the main CPU 111*c* generates a reset signal RST2 to reactivate the sub-CPU 121*c*. Further, the main CPU 111*c* watches for a communication abnormality in the first and second ancillary integrated circuit devices 120*c* and 140*c*, and generates an error signal ER1 at steps 508, 527, or 535 shown in FIG. 5 upon occurrence of an abnormality.

On the other hand, the watchdog timer 129 which is provided outside the core integrated circuit device 110*c* incorporating the main CPU 111*c* watches for a runaway of the main CPU 111*c* using a watchdog signal WD1. Upon occurrence of an abnormality, the watchdog timer 129 generates a reset signal RST1 to reactivate the main CPU 111*c* as well as the sub-CPU 121*c*.

Now assume a case that a reset signal RST1 or RST2 has been generated due to a temporary noise-induced erroneous operation. In this case, the main CPU 111*c* or the sub-CPU 121*c* is reset and reactivated and comes to generate a normal watchdog signal WD1 or WD2 again.

Therefore, the vehicular electronic control apparatus 100*c* restores a normal operation state in such a manner that the driver does not realize it.

However, when a reset signal RST1 or RST2 or an error signal ER1 has been generated, even if it is due to a temporary erroneous operation, the reset or error signal is stored in the abnormality storage circuit 160 and the abnormality alarm device 165 operates.

The stored abnormality signal is not erased unless the power switch 105*y* is opened once. Therefore, the driver can realize the occurrence of the noise-induced erroneous operation. If such erroneous operations occur frequently, the driver will judge that the situation is dangerous and have his vehicle inspected.

In particular, where the vehicular electronic control apparatus 100*c* has a convenient function having great influence on the safety such as a cruise control device, safety is secured by turning off the load power relay 164*a* by the logic circuit 163 that is the gate element. Opening of the load power relay 164*a* that was caused by a temporary erroneous operation can be canceled by closing the power switch 105*y* again.

According to the fifth embodiment, the vehicular electronic control apparatus has the load power relay and the abnormality alarm device and the first ancillary integrated circuit device has the abnormality storage circuit, the power detection circuit, and the logic circuit. This provides an advantage that when the main CPU or the sub-CPU has run away or has been reactivated due to a temporary noise-induced erroneous operation, information indicating this fact is stored, power to a dangerous electric load is shut off, and abnormality alarming is performed to notify the driver about the abnormality. On the other hand, the basic functions necessary to rotate the engine such as the fuel injection can be maintained.

When such a temporary erroneous operation has occurred, the abnormality storage circuit can be reset and a normal operation state of the entire apparatus can be restored by restarting the engine.

The second ancillary integrated circuit device is equipped with a pair of multi-channel A/D converters. One of double-system analog sensors for the same object of measurement is connected to one of the multi-channel A/D converters, and the other double-system analog sensor is connected to the other multi-channel A/D converter. This provides advantages that the degree of redundancy can be increased by virtue of the use of the double-system A/D converters for the double-system sensors and that the delay time caused by the A/D conversion by the sequential-conversion-type multi-channel A/D converter can be shortened.

The second ancillary integrated circuit device has the digital conversion output circuit for part of the analog input signals and the first ancillary integrated circuit device has the monitoring digital conversion input circuit that is connected to the digital conversion output circuit. This provides an advantage that the degree of redundancy can be increased by the double system circuits in which digital conversion values of the part of the analog signals are monitored by the first ancillary integrated circuit device without intervention of the core integrated circuit device.

Sixth Embodiment (1) Detailed Description of Configuration of Sixth Embodiment

Figure 13:
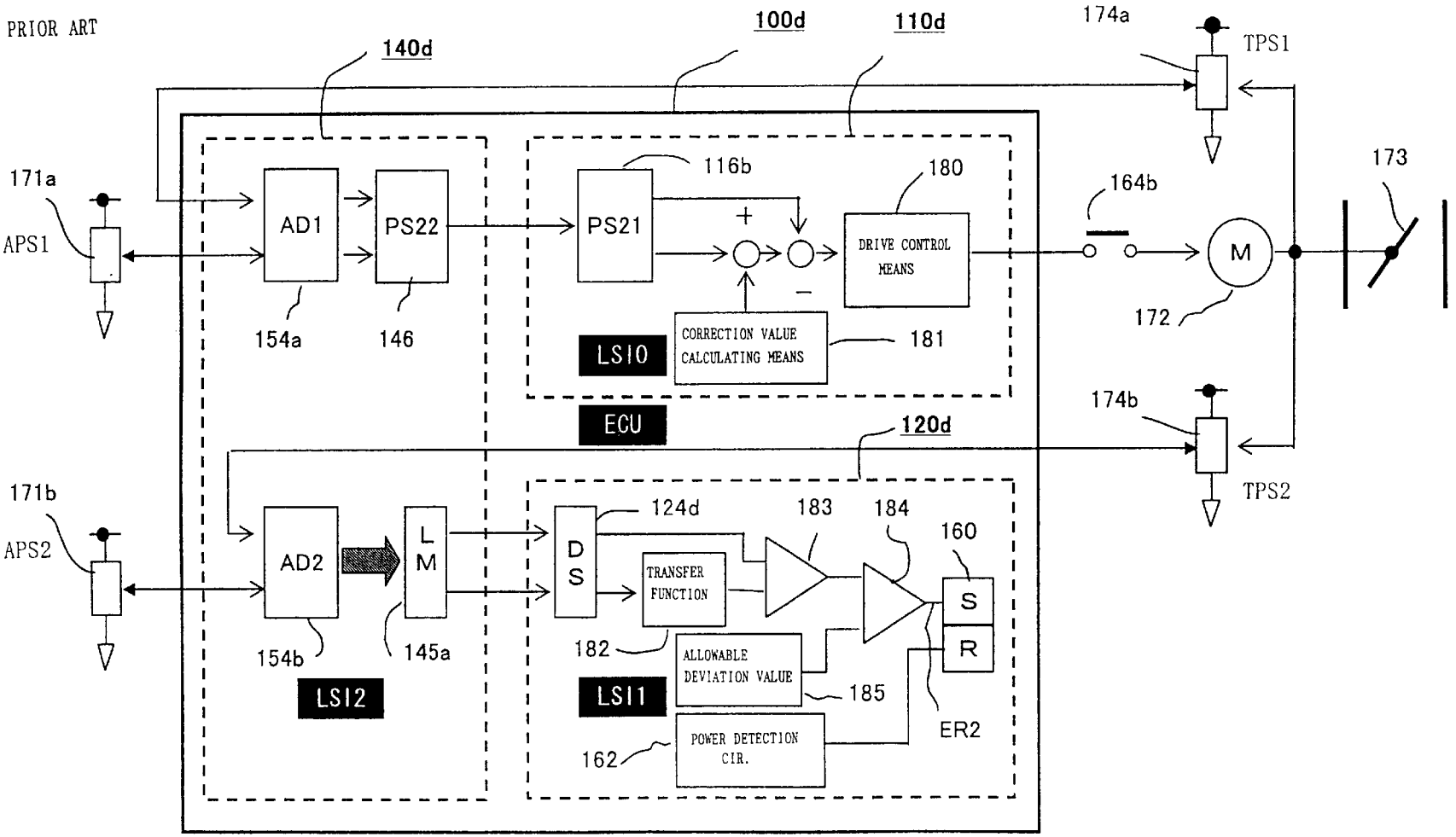
FIG. 13 PRIOR ART
FIG. 13 is a block circuit diagram of a vehicular electronic control apparatus according to a sixth embodiment of the invention.
Figure 14:
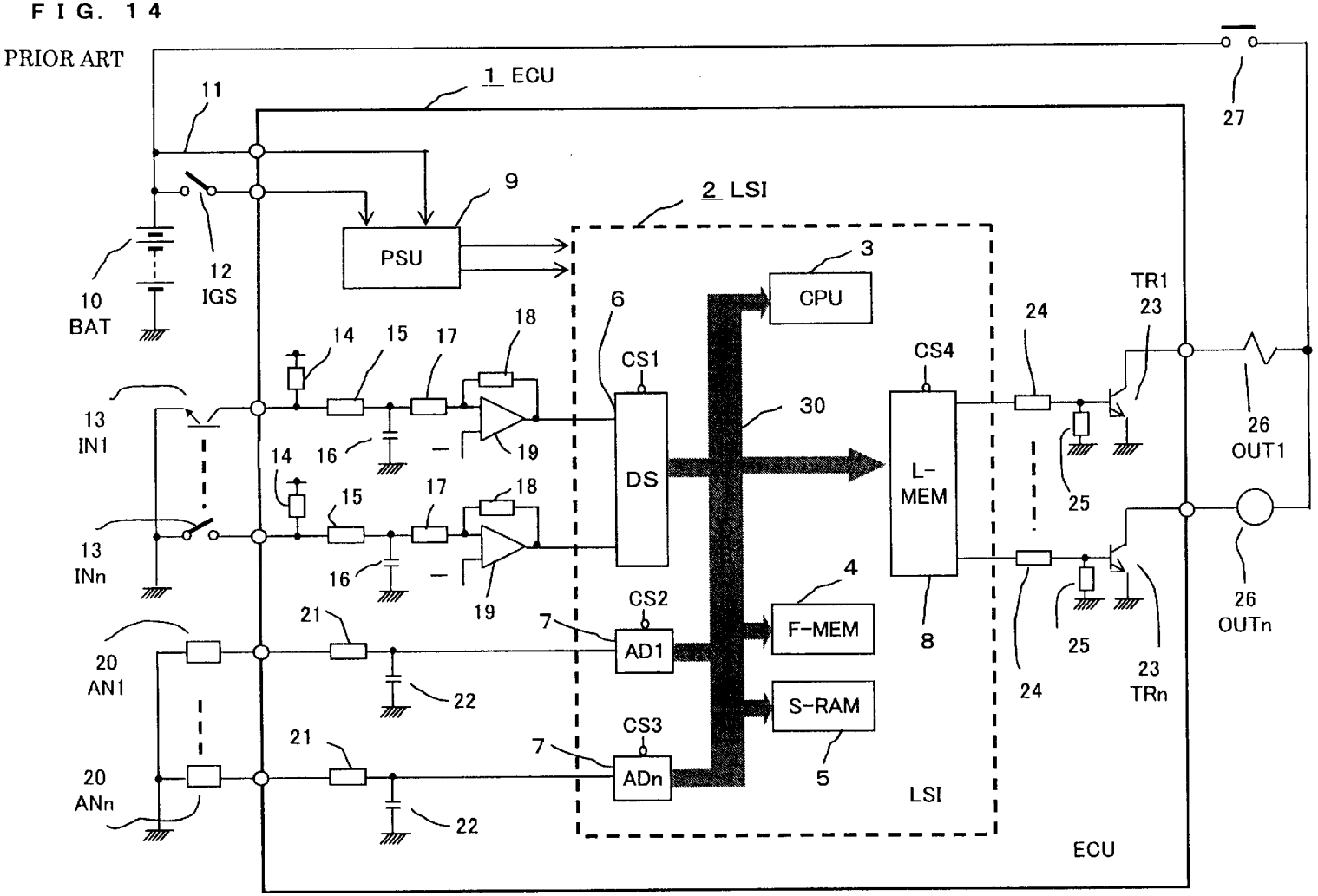
FIG. 14 PRIOR ART
FIG. 14 is a block circuit diagram of a conventional vehicular electronic control apparatus.

A vehicular electronic control apparatus according to a sixth embodiment of the invention will be described below with reference to FIG. 13. The vehicular electronic control apparatus of FIG. 13 is the one obtained by adding several functions to the vehicular electronic control apparatus of FIG. 12. FIG. 13 is a block circuit diagram of the vehicular electronic control apparatus according to the sixth embodiment of the invention.

In FIG. 13, reference symbol 100*d* denotes an ECU (vehicular electronic control apparatus) for controlling devices to be controlled. The ECU 100*d* is a single electronic circuit board having, as major parts, a core integrated circuit device 110*d*, a first ancillary integrated circuit device 120*d*, and a second ancillary integrated circuit device 140*d*.

Reference symbols 171*a* and 171*b* denote first and second accelerator position sensors for detecting the degree of a press on the accelerator, which constitute a double system. Reference numeral 172 denotes a motor for opening and closing an engine intake valve 173. Reference symbols 174*a* and 174*b* denote first and second throttle position sensors, constituting a double system, for detecting the degree of opening of the intake valve 173 that is driven by the motor 172. The first and second accelerator position sensors 171*a* and 171*b* are first and second target value input sensors, respectively, and the first and second throttle position sensors 174*a* and 174*b* are first and second detection value input sensors, respectively. The motor 172 is an automatic control electric load.

Equipped with a main CPU (microprocessor) having a first nonvolatile memory and a first RAM for computation (all of which are not shown), the core integrated circuit device 110*d* drive-controls the motor 172 by means of this microprocessor that serves as an automatic control means 180.

A first target value of the first accelerator position sensor 171*a* and a first detection value of the first throttle position sensor 174*a* are converted by a multi-channel A/D converter 154*a* of the second ancillary integrated circuit device 140*d* into digital values, which are sent as serial signals by a second child station serial/parallel converter 146 and captured by the main CPU via a second parent station serial/parallel converter 116*b*. And the automatic control means 180 operates in accordance with a deviation value between the first target value and the first detection value.

Reference numeral 181 denotes a correction value calculating means that responds to an engine water temperature, a use state of the air-conditioner, and a press or return speed of the accelerator. For example, when the engine water temperature is low, the correction value calculating means 181 performs correction control so as to make the degree of opening of the intake valve somewhat higher even for the same degree of a press on the accelerator.

Reference symbol 164*b* denotes the output contact of the load power relay 164*a* that was described above with reference to FIG. 12. When an abnormality has occurred, the circuit of supplying power to the motor 172 is opened forcibly.

In the first ancillary integrated circuit device 120*d*, reference numeral 124*d* denotes a monitoring input circuit such as a data selector. Reference numeral 182 denotes an approximated transfer function of the entire actuator system from the motor 172 to the first or second throttle position sensor 174*a* or 174*b*. Reference numerals 183 and 184 denote comparing means that constitute automatic control monitoring means. Reference numeral 185 denotes an allowable deviation value for abnormality judgment. A monitoring output circuit 145*a* is connected to the monitoring input circuit 124*d*. Digital conversion values of an analog value (second target value) of the second accelerator position sensor 171*b* and an analog value (second detection value) of the second throttle position sensor 174*b* that were input to the multi-channel A/D converter 154*b* are stored in the monitoring input circuit 124*d*.

The digital value of the degree of opening of the intake valve (second detection value) that has been detected by the second throttle position sensor 174*b* is input to the comparing means 183 as one input value. An output of the approximated transfer function 182 that has, as an input, the digital value of the degree of the press on the accelerator (second target value) that has been detected by the second accelerator position sensor 171*b* is input to the comparing means 183 as the other input value.

One input value of the comparing means 184 is a comparison deviation value of the comparing means 183 and the other input value is the allowable deviation value. If the absolute value of the comparison deviation value of the comparing means 183 exceeds the allowable deviation value, information indicating an abnormality is stored in the abnormality storage circuit 160 shown in FIG. 12. This storage state is canceled by the power detection circuit 162.

The approximated transfer function 182 and the allowable deviation value 185 are stored in a second nonvolatile memory (not shown). The digital comparison by the comparing means 182 and 184 is performed by a sub-CPU (microprocessor; not shown).

(2) Detailed Description of Operation of Sixth Embodiment

The operation of the above-configured vehicular electronic control apparatus according to the sixth embodiment will be summarized below. The main CPU of the core integrated circuit device 110*d*, which serves as the automatic control means 180, responds to a first target value of the first accelerator position sensor 171*a* and a first detection value of the first throttle position sensor 174*a* that are input via the second ancillary integrated circuit device 140*d* and controls the automatic control electric load 172.

The sub-CPU of the first integrated circuit device 120*d*, which serves as the automatic control monitoring means 183 and 184, responds to a second target value of the second accelerator position sensor 171*b* and a second detection value of the second throttle position sensor 174*b* and monitors the operation of the automatic control electric load 172. When a control abnormality signal ER2 has occurred, information indicating the abnormality is stored in the abnormality storage circuit 160 and the power to the load 107 is shut off.

As for the connection between the monitoring output circuit 145*a* and the monitoring input circuit 124*d*, a serial connection method using a third serial/parallel converter may be used. In this case, other analog input signals can be monitored by the first ancillary integrated circuit device 120*d* without increasing the number of connection pins.

In the sixth embodiment, the second ancillary integrated circuit device receives first and second target values that are double-system analog values having the same value and first and second detection values that are also double-system analog values having the same value and has the monitoring output circuit for the second target value and the second detection value. The first ancillary integrated circuit device has the automatic control monitoring means (sub-CPU) and the monitoring input circuit that is connected to the monitoring output circuit. As such, the sixth embodiment provides an advantage that the safety can be improved by monitoring the operation of the main CPU of the core integrated circuit device by the sub-CPU.

Other Embodiments

In the first to sixth embodiments described above, the core integrated circuit device and the first and second ancillary integrated circuit devices can be integrated with each other physically. In this case, the boundaries between the integrated circuit devices are located between the sections that are connected to each other by serial communication.

Although the first to sixth embodiments do not handle analog output signals, a D/A converter for meter indication may be provided as an indirect output device in the second ancillary integrated circuit device.

The actual situation is such that the number of control points for indirect control is not large. Therefore, the main CPU may directly output all of those signals via the direct parallel output circuit without using serial communication.

A minimum number of input signals of low-speed operations that are necessary to maintain the engine rotation may directly be input to the main CPU without using serial communication. This is effective in performing an emergency escape operation.

The sub-CPU may be provided in various manners: it may be provided in both of, only one of, or neither of the first and second ancillary integrated circuit devices. The best hardware configuration of the invention is such that the sub-CPU is incorporated in the first ancillary integrated circuit device to improve the mutual monitoring function and no CPU is provided in the second ancillary integrated circuit device to prevent mixed use of analog techniques and digital techniques.

The input and output information exchange time can be shorted by connecting a DMAC (direct memory access controller) to the main-CPU-side data bus and directly exchanging input and output information between the serial/parallel converter and the first RAM during internal computation periods when the main CPU does not use the data bus.

In the first to sixth embodiments, information indicating an abnormality in a watchdog signal or a communication abnormality is stored even if it has occurred only once and shutting-off of power to related loads and alarm indication are continued even after the abnormal state has finished. Alternatively, a counter circuit may be provided so that shutting-off of power to related loads and alarm indication are performed only when such a temporary abnormality has occurred plural times or while it is continuing.

In the first to sixth embodiments, all filter constants and threshold constants are stored in the main-CPU-side first nonvolatile memory. Alternatively, a writable second nonvolatile memory may be provided in the sub-CPU so that control programs for input/output processing, filter constants, etc. are written to it from an external tool, or a nonvolatile memory such as an EEPROM may be provided in an ancillary integrated circuit device so that various constants are written to it in advance.

The additional features of the vehicular electronic control apparatus according to the invention will be summarized below.

A first additional feature of the vehicular electronic control apparatus according to the invention is as follows. The first ancillary integrated circuit device further includes an indirect parallel output circuit for outputting control signals generated by the core integrated circuit device to second control object devices.

The first additional feature makes it possible to decrease the number of control output pins of the core integrated circuit device and thereby miniaturize and standardize the core integrated circuit device further.

A second additional feature of the vehicular electronic control apparatus according to the invention is as follows. The microprocessor generates a watchdog signal. The core integrated circuit device further includes first mutual monitoring means for performing a time limit check and a sum check based on the digital signals received from the first ancillary integrated circuit device and the digital signals received from the second ancillary integrated circuit device. At least one of the first ancillary integrated circuit device and the second ancillary integrated circuit device further includes second mutual monitoring means for resetting the microprocessor when a pulse width of the watchdog signal generated by the microprocessor has exceeded a prescribed value.

The second additional feature makes it possible to improve the safety from a noise-induced erroneous operation that might otherwise be caused by the configuration that the integrated circuit devices are separated from each other by using the serial communication circuits.

A third additional feature of the vehicular electronic control apparatus according to the invention is as follows. At least one of the first ancillary integrated circuit device and the second ancillary integrated circuit device further includes a sub-microprocessor that generates a watchdog signal, and the first mutual monitoring means includes a runaway monitoring program that serves to reset the sub-microprocessor when a pulse width of the watchdog signal generated by the sub-microprocessor has exceeded a prescribed value.

The third additional feature makes it possible to watch for a runaway of the sub-microprocessor by the first mutual monitoring means.

A fourth additional feature of the vehicular electronic control apparatus according to the invention is as follows. The ancillary integrated circuit device further includes an abnormality storage circuit for storing information indicating an abnormality detected by the first mutual motoring means and the second mutual motoring means, a power detection circuit for resetting the abnormality storage circuit when detecting application of power to the vehicular electronic control apparatus, and a logic circuit for opening a load power relay that is connected to a power circuit of a control object device while the information indicating the abnormality is stored in the abnormality storage circuit.

In the fourth additional feature, when a temporary noise-induced erroneous operation has occurred in the microprocessor or the sub-microprocessor, information indicating the abnormality is stored. Also, when the microprocessor or the sub-microprocessor has run away or has been reactivated due to a temporary noise-induced erroneous operation, information indicating this fact is stored, power to a dangerous electric load is shut off, and abnormality alarming is performed to notify the driver about the abnormality while the basic functions necessary to rotate the engine such as the fuel injection can be maintained. When such a temporary erroneous operation has occurred, the abnormality storage circuit can be reset and a normal operation state can be restored by restarting the engine.

A fifth additional feature of the vehicular electronic control apparatus according to the invention is as follows. Each of input circuit sections of the indirect parallel input circuit of the first ancillary integrated circuit device includes an input interface section and a variable filter circuit. The input interface section includes a noise filter having a small-capacitance capacitor and a large-resistance series resistor that is connected to a small-resistance bleeder resistor as a load of an input switch, and a level judgment comparator having a hysteresis function. The variable filter circuit includes an input determination flip-flop circuit that is set when a large part of consecutive level judgment results that have been sampled at a prescribed period and stored are true, and that is reset when the large part of consecutive level judgment results are false, and a constant setting register in which at least one of the sampling period and the number of set/reset logical judgment points is stored as a filter constant.

According to the fifth additional feature, filter circuits having a sufficient smoothing function can be formed by using small-capacitance capacitors that can be incorporated in the first ancillary integrated circuit device and their filter constants can be changed easily. This results in an advantage that the input circuit sections can be miniaturized and standardized.

A sixth additional feature of the vehicular electronic control apparatus according to the invention is as follows. The variable filter circuit further includes a reversible counter for reversibly counting clocks depending on an output logical level of the level judgment comparator. The input determination flip-flop is set when a current value of the reversible counter has reached a setting value, and is reset when the current value of the reversible counter has become 0.

The sixth additional feature provides an advantage that the decision-by-majority logical judgment for generating an input signal to the input determination flip-flop is facilitated.

A seventh additional feature of the vehicular electronic control apparatus according to the invention is as follows. The first ancillary integrated circuit device further includes a second RAM for computation, a second nonvolatile memory, and a sub-microprocessor. Each of input circuit sections of the indirect parallel input circuit of the first ancillary integrated circuit device includes an input interface section and a variable filter means. The input interface section includes a noise filter having a small-capacitance capacitor and a large-resistance series resistor that is connected to a small-resistance bleeder resistor as a load of an input switch, and a level judgment comparator having a hysteresis function. The variable filter means includes an input determination program that is stored in the second nonvolatile memory and executed by the sub-microprocessor, and that is set when a large part of consecutive level judgment results that have been sampled at a prescribed period and stored are true and is reset when the large part of consecutive level judgment results are false. At least one of the sampling period and the number of set/reset logical judgment points is stored in the second RAM as a filter constant.

According to the seventh additional feature, filter circuits having a sufficient smoothing function can be formed by software by using small-capacitance capacitors that can be incorporated in the first ancillary integrated circuit device and their filter constants can be changed easily. This results in an advantage that the input circuit sections can be miniaturized and standardized.

An eighth additional feature of the vehicular electronic control apparatus according to the invention is as follows. The first ancillary integrated circuit device further comprises input interface sections that are provided immediately upstream of the direct parallel input circuit of the core integrated circuit device. Each of the input interface sections comprises a noise filter comprising a small-capacitance capacitor and a large-resistance series resistor that is connected to a small-resistance bleeder resistor as a load of an input switch, and a level judgment comparator having a hysteresis function or a variable threshold circuit that comprises a level judgment comparator having a hysteresis function and a constant setting register in which a setting value of a judgment level of the level judgment comparator is stored.

According to the eighth feature, equivalent variable filters are formed for the high-speed operation direct parallel input circuit though they are effective only in limited ranges and their filter constants can be changed easily. This results in an advantage that the input circuit sections can be miniaturized and standardized.

A ninth additional feature of the vehicular electronic control apparatus according to the invention is as follows. Each of channel input circuit sections of the multi-channel analog-to-digital converter of the second ancillary integrated circuit device includes an input interface circuit including a noise filter having a positive-side clip diode, a negative-side clip diode, and a small-capacitance capacitor, and a variable filter circuit including an equivalent resistor of a switched capacitor or a variable resistor including a selectively switched resistor, a capacitor connected to the equivalent resistor or the variable resistor, and a constant setting register in which a filter constant that determines a switching period of the switched capacitor or a resistance value of the variable resistor is stored.

According to the ninth additional feature, filter circuits having a sufficient smoothing function can be formed by using small-capacitance capacitors that can be incorporated in the second ancillary integrated circuit device and their filter constants can be changed easily. This results in an advantage that the input circuit sections can be miniaturized and standardized.

A 10th additional feature of the vehicular electronic control apparatus according to the invention is as follows. The second ancillary integrated circuit device further includes a second RAM for computation, a second nonvolatile memory, and a sub-microprocessor. Each of channel input circuit sections of the multi-channel analog-to-digital converter of the second ancillary integrated circuit device includes an input interface section and a variable filter means. The input interface section includes a noise filter having a positive-side clip diode, a negative-side clip diode, and a small-capacitance capacitor. The variable filter means includes a moving average calculation program that is stored in the second nonvolatile memory and executed by the sub-microprocessor, and that calculates an average value of consecutive digital conversion values that have been sampled at a prescribed period and stored. At least one of the sampling period and the number of moving average calculation points is stored in the second RAM as a filter constant.

According to the 10th additional feature, filter circuits having a sufficient smoothing function can be formed by software by using small-capacitance capacitors that can be incorporated in the second ancillary integrated circuit device and their filter constants can be changed easily. This results in an advantage that the input circuit sections can be miniaturized and standardized.

An 11th additional feature of the vehicular electronic control apparatus according to the invention is as follows. Control constants including at least one of the filter constants of the variable filter circuits and threshold constants of the variable threshold circuits and a constant transfer program that is executed by the microprocessor and serves to transfer the control constants to the constant setting registers are stored in the first nonvolatile memory of the core integrated circuit device.

The 11th additional feature makes it possible to manage control constants such as filter constants and threshold constants for various control object devices in a unified manner and to change the control constants easily.

A 12th additional feature of the vehicular electronic control apparatus according to the invention is as follows. Control constants including at least one of the filter constants of the variable filter circuits and threshold constants of the variable threshold circuits and a constant transfer program that is executed by the microprocessor and serves to transfer the control constants to the constant setting registers are stored in the first nonvolatile memory of the core integrated circuit device. A constant reception program that serves to receive the control constants that are transferred being controlled by the constant transfer program is stored in the second nonvolatile memory.

The 12th additional feature makes it possible to manage control constants such as filter constants and threshold constants for various control object devices in a unified manner and to change the control constants easily.

A 13th additional feature of the vehicular electronic control apparatus according to the invention is as follows. The first ancillary integrated circuit device further includes a second nonvolatile memory, a second RAM for computation, a sub-microprocessor to which the second nonvolatile memory and the second RAM are bus-connected. Input interface circuits and a monitoring parallel input circuit that are provided in a front stage of the direct parallel input circuit of the core integrated circuit device. Each of the input interface sections includes a noise filter including a small-capacitance capacitor and a large-resistance series resistor that is connected to a small-resistance bleeder resistor as a load of an input switch, and a level judgment comparator having a hysteresis function. The monitoring parallel input circuit that is a data selector that selectively bus-connects the outputs of the level judgment comparators to the sub-microprocessor.

According to the 13th additional feature, the sub-processor can watch for an abnormality such as disconnection or short-circuiting in various input sensors that are connected to the direct parallel input circuit that is bus-connected to the microprocessor. As a result, the loads of the microprocessor can be reduced by function distribution.

A 14th additional feature of the vehicular electronic control apparatus according to the invention is as follows. The second ancillary integrated circuit device includes two multi-channel analog-to-digital converters, and double-system analog sensors that are provided for the same measurement object are connected to the two multi-channel analog-to-digital converters, respectively.

The 14th additional feature makes it possible to increase the degree of redundancy by using the double-system multi-channel analog-to-digital converters for a double-system sensors.

A 15th additional feature of the vehicular electronic control apparatus according to the invention is as follows. The second ancillary integrated circuit device further includes a digital conversion output circuit provided for part of the analog signals, for converting the part of the analog signals into digital signals. The first ancillary integrated circuit device further includes a monitoring digital conversion input circuit that is connected to the output of the digital conversion output circuit.

According to the 15th additional feature, the degree of redundancy can be increased by the double-system circuits in which digital conversion values of part of the analog signals are monitored by the first ancillary integrated circuit device without intervention of the core integrated circuit device.

A 16th additional feature of the vehicular electronic control apparatus according to the invention is as follows. The core integrated circuit device further includes automatic control means for controlling a control object device according to a control program that is stored in the first nonvolatile memory. The first ancillary integrated circuit device includes automatic control monitoring means for monitoring the control object device according to a control program that is stored in the second nonvolatile memory.

The 16th additional feature makes it possible to improve the safety by the automatic control monitoring means monitoring the automatic control means of the core integrated circuit device.

A 17th additional feature of the vehicular electronic control apparatus according to the invention is as follows. The second ancillary integrated circuit device receives first and second target values as double-system analog values having the same value, first and second detection values that are obtained by detecting operation of the control object device and correspond to the first and second target values, respectively. The second ancillary integrated circuit device includes a monitoring output circuit for outputting the second target value and the second detection value. The first ancillary integrated circuit device includes a monitoring input circuit that is connected to the monitoring output circuit. The automatic control means of the core integrated circuit device controls the control object device based on the first target value and the first detection value that are supplied from the second ancillary integrated circuit device. The automatic control monitoring means of the first ancillary integrated circuit device compares an output of an approximated transfer function of an actuator system of the control object device that is produced when the second target value obtained from the monitoring input circuit is input to the approximated transfer function, with the second detection value obtained from the monitoring input circuit. The automatic control monitoring means generates a control error signal if a resulting comparison deviation is greater than a prescribed value and thereby sets the abnormality storage circuit.

The 17th additional feature makes it possible to improve the safety by monitoring the operation of the microprocessor of the core integrated circuit device using the sub-microprocessor and storing information indicating an abnormality upon its occurrence.

What is claimed is:

1. A vehicular electronic control apparatus comprising:

a core integrated circuit device including a microprocessor, a first ancillary integrated circuit device for receiving low-speed digital signals connected to the core integrated circuit device in such manner that serial communication is performed with each other and a second ancillary integrated circuit device for receiving analog signals connected to the core integrated circuit device in such manner that serial communication is performed with each other, wherein the core integrated circuit device includes:

a direct parallel input circuit and a direct parallel output circuit for inputting and outputting signals from and to control object devices, a first parent station serial/parallel converter and a second parent station serial/parallel converter, a first nonvolatile memory to which control programs that serve to control the control object devices are written from an external tool, and a first RAM for computation, and the microprocessor of the core integrated circuit device to which the direct parallel input circuit, the direct parallel output circuit, the first and second parent station serial/parallel converters, the first nonvolatile memory, and the first RAM are bus-connected;

the first ancillary integrated circuit device includes:

a first child station serial/parallel converter connected to the first parent serial/parallel converter of the core integrated circuit device in such a manner that serial communication is performed with each other, and an indirect parallel input circuit for receiving the low-speed digital signals in parallel, and the first ancillary integrated circuit device outputs the digital signals received by the indirect parallel input circuit to the core integrated circuit device through the first child station serial/parallel converter, and the second ancillary integrated circuit device includes:

a second child station serial/parallel converter connected to the core integrated circuit device in such a manner that serial communication is performed with each other, and a multi-channel analog-to-digital converter for receiving the analog signals parallel and for converting the received analog signals into digital signals, and the second ancillary integrated circuit device outputs the digital signals converted by the multi-channel analog-to-digital converter to the core integrated circuit device through the second child station serial/parallel converter, and wherein the core integrated circuit device generates control signals based on the input signals received from the control object devices, the digital signals received from the first ancillary integrated circuit device, and the digital signals received from the second ancillary integrated circuit device, and outputs the generated control signals to the control object devices.

2. The vehicular electronic control apparatus according to claim 1, wherein the first ancillary integrated circuit device further includes an indirect parallel output circuit for outputting control signals generated by the core integrated circuit device to the control object devices.

3. The vehicular electronic control apparatus according to claim 1, wherein the microprocessor generates a watchdog signal, wherein the core integrated circuit device further includes first mutual monitoring means for performing a time out check and a sum check based on the digital signals received from the first ancillary integrated circuit device and the digital signals received from the second ancillary integrated circuit device, and wherein at least one of the first ancillary integrated circuit device and the second ancillary integrated circuit device further includes second mutual monitoring means for resetting the microprocessor when a pulse width of the watchdog signal generated by the microprocessor has exceeded a prescribed value.

4. The vehicular electronic control apparatus according to claim 3, wherein at least one of the first ancillary integrated circuit device and the second ancillary integrated circuit device further includes a sub-microprocessor that generates a watchdog signal, and wherein the first mutual monitoring means includes a runaway monitoring program that serves to reset the sub-microprocessor when a pulse width of the watchdog signal generated by the sub-microprocessor has exceeded a prescribed value.

5. The vehicular electronic control apparatus according to claim 3, wherein the first ancillary integrated circuit device further includes;

an abnormality storage circuit for storing information indicating an abnormality detected by the first mutual motoring means and the second mutual motoring means, a power detection circuit for resetting the abnormality storage circuit when detecting application of power to the vehicular electronic control apparatus, and a logic circuit for opening a load power relay that is connected to a power circuit for the control object device while the information indicating the abnormality is stored in the abnormality storage circuit.

6. The vehicular electronic control apparatus according to claim 5, wherein the core integrated circuit device further includes automatic control means for controlling a control object device according to a control program that is stored in the first nonvolatile memory, and wherein the first ancillary integrated circuit device includes automatic control monitoring means for monitoring the control object device according to a control program that is stored in a second nonvolatile memory.

7. The vehicular electronic control apparatus according to claim 6, wherein:

the second ancillary integrated circuit device receives first and second target values as double-system analog values having the same value, first and second detection values that are obtained by detecting operation of the control object device and correspond to the first and second target values, respectively, and the second ancillary integrated circuit device includes a monitoring output circuit for outputting the second target value and the second detection value, the first ancillary integrated circuit device includes a monitoring input circuit that is connected to the monitoring output circuit, the automatic control means of the core integrated circuit device controls the control object device based on the first target value and the first detection value that are supplied from the second ancillary integrated circuit device, and the automatic control monitoring means of the first ancillary integrated circuit device compares an output of an approximated transfer function of an actuator system of the control object device that is produced when the second target value obtained from the monitoring input circuit is input to the approximated transfer function, with the second detection value obtained from the monitoring input circuit, and the automatic control monitoring means generates a control error signal if a resulting comparison deviation is greater than a prescribed value and thereby sets the abnormality storage circuit.

8. The vehicular electronic control apparatus according to claim 1, wherein each of input circuit sections of the indirect parallel input circuit of the first ancillary integrated circuit device includes an input interface section and a variable filter circuit, the input interface section includes;

a noise filter having a small-capacitance capacitor and a large-resistance series resistor that is connected to a small-resistance bleeder resistor as a load of an input switch and a level judgment comparator having a hysteresis function, and the variable filter circuit includes;

an input determination flip-flop circuit that is set when a large part of consecutive level judgment results that have been sampled at a prescribed period and stored are true, and that is reset when the large part of consecutive level judgment results are false and a constant setting register in which at least one of the sampling period and the number of set/reset logical judgment points is stored as a filter constant.

9. The vehicular electronic control apparatus according to claim 8, wherein the variable filter circuit further includes a reversible counter for reversibly counting clock signal depending on an output logical level of the level judgment comparator, and wherein the input determination flip-flop is set when a current value of the reversible counter has reached a setting value, and is reset when the current value of the reversible counter has become 0.

10. The vehicular electronic control apparatus according to claim 8, wherein the first ancillary integrated circuit device further includes an input interface section and a variable threshold circuit that are provided in a front stage of the direct parallel input circuit of the core integrated circuit device, the input interface section includes;

a noise filter having a small-capacitance capacitor and a large-resistance series resistor that is connected to a small-resistance bleeder resistor as a load of an input switch, and the variable threshold circuit includes;

a level judgment comparator having a hysteresis function, and a constant setting register in which a setting value of a judgment level of the level judgment comparator is stored.

11. The vehicular electronic control apparatus according to claim 8, wherein control constants including at least one of the filter constants of the variable filter circuits and threshold constants of the variable threshold circuits and a constant transfer program that is executed by the microprocessor and serves to transfer the control constants to the constant setting registers are stored in the first nonvolatile memory of the core integrated circuit device.

12. The vehicular electronic control apparatus according to claim 1, wherein the first ancillary integrated circuit device further includes a second RAM for computation, a second nonvolatile memory, and a sub-microprocessor, and wherein each of input circuit sections of the indirect parallel input circuit of the first ancillary integrated circuit device includes an input interface section and a variable filter means, the input interface section includes;

a noise filter having a small-capacitance capacitor and a large-resistance series resistor that is connected to a small-resistance bleeder resistor as a load of an input switch, and a level judgment comparator having a hysteresis function, and the variable filter means includes;

an input determination program that is stored in the second nonvolatile memory and executed by the sub-microprocessor, and that is set when a large part of consecutive level judgment results that have been sampled at a prescribed period and stored are true and is reset when the large part of consecutive level judgment results are false, and wherein at least one of the sampling period and the number of set/reset logical judgment points is stored in the second RAM as a filter constant.

13. The vehicular electronic control apparatus according to claim 12, wherein control constants including at least one of the filter constants of the variable filter circuits and threshold constants of the variable threshold circuits and a constant transfer program that is executed by the microprocessor and serves to transfer the control constants to the constant setting registers are stored in the first nonvolatile memory of the core integrated circuit device, and wherein a constant reception program that serves to receive the control constants that are transferred being controlled by the constant transfer program is stored in the second nonvolatile memory.

14. The vehicular electronic control apparatus according to claim 1, wherein each of channel input circuit sections of the multi-channel analog-to-digital converter of the second ancillary integrated circuit device includes an input interface circuit and a variable filter circuit, the input interface circuit includes a noise filter having a positive-side clip diode, a negative-side clip diode, and a small-capacitance capacitor, and the variable filter circuit includes;

an equivalent resistor of a switched capacitor, a capacitor connected to the equivalent resistor, and a constant setting register in which a filter constant that determines a switching period of the switched capacitor is stored.

15. The vehicular electronic control apparatus according to claim 14, wherein the second ancillary integrated circuit device includes two multi-channel analog-to-digital converters, and wherein double-system analog sensors that are provided for the same measurement object are connected to the two multi-channel analog-to-digital converters, respectively.

16. The vehicular electronic control apparatus according to claim 14, wherein the second ancillary integrated circuit device further includes a digital conversion output circuit provided for part of the analog signals, for converting the part of the analog signals into digital signals, and wherein the first ancillary integrated circuit device further includes a monitoring digital conversion input circuit that is connected to an output of the digital conversion output circuit.

17. The vehicular electronic control apparatus according to claim 1, wherein each of channel input circuit sections of the multi-channel analog-to-digital converter of the second ancillary integrated circuit device includes an input interface circuit and a variable filter circuit, the input interface circuit includes a noise filter having a positive-side clip diode, a negative-side clip diode, and a small-capacitance capacitor, and the variable filter circuit includes;

a variable resistor including a selectively switched resistor, a capacitor connected to the variable resistor, and a constant setting register in which a filter constant that determines a resistance value of the variable resistor is stored.

18. The vehicular electronic control apparatus according to claim 1, wherein the second ancillary integrated circuit device further includes a second RAM for computation, a second nonvolatile memory, and a sub-microprocessor, and each of channel input circuit sections of the multi-channel analog-to-digital converter of the second ancillary integrated circuit device includes an input interface section and a variable filter means, the input interface section includes a noise filter having a positive-side clip diode, a negative-side clip diode, and a small-capacitance capacitor, and the variable filter means includes a moving average calculation program that is stored in the second nonvolatile memory and executed by the sub-microprocessor, and that calculates an average value of consecutive digital conversion values that have been sampled at a prescribed period and stored, and wherein at least one of the sampling period and the number of moving average calculation points is stored in the second RAM as a filter constant.

19. The vehicular electronic control apparatus according to claim 1, wherein the first ancillary integrated circuit device further includes;

a second nonvolatile memory, a second RAM for computation, a sub-microprocessor to which the second nonvolatile memory and the second RAM are bus-connected, and input interface circuits and a monitoring parallel input circuit that are provided in a front stage of the direct parallel input circuit of the core integrated circuit device, each of the input interface sections includes;

a noise filter comprising a small-capacitance capacitor and a large-resistance series resistor that is connected to a small-resistance bleeder resistor as a load of an input switch, and a level judgment comparator having a hysteresis function; and the monitoring parallel input circuit that is a data selector that selectively bus-connects outputs of the level judgment comparators to the sub-microprocessor.

* * * * *